US007073476B2

(12) United States Patent
Yamamura et al.

(10) Patent No.: US 7,073,476 B2
(45) Date of Patent: Jul. 11, 2006

(54) CYLINDER BLOCK

(75) Inventors: Satoshi Yamamura, Saitama (JP); Kazuo Shibata, Saitama (JP); Tadashi Ohya, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/150,272

(22) Filed: Jun. 13, 2005

(65) Prior Publication Data

US 2005/0279315 A1 Dec. 22, 2005

(30) Foreign Application Priority Data

Jun. 16, 2004 (JP) ..... 2004-177771
Jun. 16, 2004 (JP) ..... 2004-177773

(51) Int. Cl.
*F02F 7/00* (2006.01)

(52) U.S. Cl. ..... 123/195 R; 164/28

(58) Field of Classification Search ..... 123/195 R; 164/28, 137, 369
See application file for complete search history.

(56) References Cited

U.S. PATENT DOCUMENTS 4,906,295 A * 3/1990 Miyamoto et al. ..... 75/239

FOREIGN PATENT DOCUMENTS

JP 2000-240502 9/2000
JP 2002-224816 8/2002

* cited by examiner

*Primary Examiner*—Noah P. Kamen
(74) *Attorney, Agent, or Firm*—Arent Fox, PLLC.

(57) ABSTRACT

In a cylinder block, at least one member disposed around a bore is made of a metal matrix composite including a ceramic compact having a three-dimensional mesh structure comprised of a plurality of spherical cells and a plurality of communicating pores for allowing adjacent spherical cells to communicate with each other, with the plurality of spherical cells filled with a metal.

15 Claims, 12 Drawing Sheets

CYLINDER BLOCK

CROSS-REFERENCE TO RELATED APPLICATIONS

This application claims the foreign priority benefit under Title 35, United States Code, § 119 (a)–(d), of Japanese Patent Application Nos. 2004-177771 and 2004-177773, filed on Jun. 16, 2004 in the Japan Patent Office, the disclosure of which is herein incorporated by reference in its entirety.

BACKGROUND OF THE INVENTION

This invention relates to a cylinder block of an internal combustion engine.

Typically, the cylinder block of the engine has a deck surface and a cylinder head is fastened over the deck surface using so-called "head bolts", with a head gasket (hereinafter referred to simply as "gasket") placed between the cylinder block and the cylinder head. See for example JP 2000-240502 A, paragraphs 0019–0026, FIGS. 1–5.

In this instance, the cylinder block and the cylinder head provided in the engine are die-cast components formed of a light alloy for weight reduction. The cylinder block, gasket and cylinder head of the engine each have bolt holes provided at predetermined positions corresponding to one another, and head bolts made of steel are inserted into the bolt holes of the cylinder head, gasket and cylinder block, and then screwed in the bolt holes provided in the cylinder block, thereby fastening the cylinder block and the cylinder head together.

However, the cylinder block as disclosed in JP 2000-240502 A is made of a light alloy such as an aluminum (Al) alloy or a magnesium (Mg) alloy, which is greater in coefficient of thermal expansion than the head bolts made of steel. Therefore, when the engine becomes hot during operation, the bolt holes of the cylinder block tend to expand in their axial directions more than the head bolts, and thus the axial fastening force of the head bolts becomes greater.

Accordingly, the guaranteed strength against the axial fastening force of the head bolts should be determined with consideration given to the extent to which the axial fastening force becomes greater. In cases where a greater axial fastening force should be applied to the head bolts, head bolts with a higher grade of strength need to be selected. Consequently, head bolts having a larger diameter enough to exhibit a strength required to endure the axial fastening force corresponding to the selected higher grade of strength for the head bolts should be provided, which would disadvantageously restrict flexibility in designing an engine layout, or offer some other problems.

When the cylinder block made of an aluminum alloy having a greater coefficient of thermal expansion expands and contracts due to change in temperature resulting from operation of the engine, the axial fastening force of the head bolts would change considerably, which would disadvantageously impair the sealing capability of the gasket at the deck surface.

In view of the aforementioned disadvantages, it is appreciated that the axial fastening force exerted to the head bolts should preferably fall invariably within a specific range irrespective of change in temperature, i.e., regardless of whether the joint of the head bolts is under high temperature conditions or under low temperature conditions. In other words, there is a need to provide a cylinder block in which the increase in axial fastening force of the head bolts can be checked or prevented.

Disclosed in JP 2002-224816 A (paragraphs 0023, 0044; FIG. 1) is another example of a cylinder block made of an aluminum alloy for an internal combustion engine, in which reinforcements are provided on a cylinder bore (hereinafter referred to simply as "bore") to improve resistance to abrasion and to reduce resistance to the sliding action of a piston.

Typically, a cylinder liner made of such reinforcements or a cast iron of good quality, etc. is provided in a bore of the cylinder block for consideration of the resistance to abrasion and the slidability required for the bore.

However, the reinforcements of the cylinder block as disclosed in JP 2002-224816 A are made by integrally embedding into the cylinder block a metal porous body composed of a stainless steel such as Fe, Cr and Ni, and are thus heavier in mass in comparison with metal materials, such as aluminum alloys, making up the cylinder block, which would place the cylinder block at disadvantages in achieving weight and size reduction.

The cylinder block as disclosed in JP 2002-224816 A is adapted to improve the slidability of the bore, but when increase in output of an engine of the same type is desired, the engine could not help undergoing major design changes in order to attend to the associated increase in heat load and combustion pressure; this would entail the problems as follows.

(1) As the combustion pressure increases, a bearing stress placed on a gasket disposed between the cylinder head and the cylinder block should be raised to a level enough to seal an interface between the cylinder block and the cylinder head and to block combustion gases from escaping. Accordingly, in this cylinder block of which the rigidity around the bore is so low that the efficiency in application of the axial fastening force to the bolt-fastened portion of the cylinder block disposed around the bore is low, the axial fastening force of the head bolts would disadvantageously be required to be increased more to compensate the diminished axial fastening force.

(2) The increase in the bearing stress placed on the gasket would lower a buckling strength of this cylinder block at a surface on which the gasket is fastened. Therefore, a great likelihood of buckling at the surface on which the gasket is fastened would disadvantageously make it impossible to place a sufficient bearing stress on the gasket.

(3) The increase in heat load placed on a portion of this cylinder block around the bore would disadvantageously lower the heat dissipating characteristics of the portion around the bore because reinforcing of the portion around the bore could lower the heat conduction characteristics thereof.

In the above and other instances of the cylinder block for which an aluminum alloy is used and provided around the bore, disadvantages that would be entailed are as follows.

(1) Upon startup of the engine at a low temperature, a piston that is different in temperature rise characteristic from this cylinder block is raised in temperature more swiftly than the cylinder block, which would require that a clearance determined with consideration given to the coefficient of thermal expansion of the piston be provided between the cylinder block and the piston.

(2) The higher the coefficient of thermal expansion of the bore is, the more the bore expands after the engine is warmed up, which would make the clearance between the cylinder block and the piston larger, causing the piston to unsteadily sway more violently, and thus increasing noises and vibrations.

Further, the loosened fit of a piston ring of the piston would disadvantageously result in an escape of oil into a combustion chamber, which would enormously increase the amount of wasted oil, and/or an escape of combustion gas into a clunk chamber, which would greatly deteriorate the quality of oil.

In view of the circumstances, it would be desirable to provide a cylinder block having a high thermal conductivity, high rigidity and low coefficient of expansion of portions around the bore, without sacrificing the slidability of the piston inside the bore, as well as achieving weight and size reduction, and higher output.

Illustrative, non-limiting embodiments of the present invention overcome the above disadvantages and other disadvantages not described above. Also, the present invention is not required to overcome the disadvantages described above, and an illustrative, non-limiting embodiment of the present invention may not overcome any of the problems described above.

SUMMARY OF THE INVENTION

In one aspect of the present invention, a cylinder block in which a bore is provided includes at least one member made of a metal matrix composite (MMC) disposed around the bore. The metal matrix composite includes a ceramic compact (also called "preform") having a three-dimensional mesh structure comprised of a plurality of spherical cells (hollow spaces disposed in the ceramic compact) and a plurality of communicating pores (also called "windows") for allowing adjacent spherical cells to communicate with each other, with the plurality of spherical cells filled with a metal.

In the above cylinder block, a volume fraction of the ceramic compact in the metal matrix composite may preferably but not necessarily be in a range of 10 to 40%. The "volume fraction" indicates the ratio of the volume of the ceramic compact contained in the metal matrix composite to the total volume of the metal matrix composite. For example, when the volume fraction of the ceramic compact is 25%, one quarter of the total volume of the metal matrix composite is shared by the ceramic compact while the remaining three quarters are made up of the metal. In this cylinder block, a ceramic compact in which spherical cells are arranged to form a closest packed structure is used to manufacture the metal matrix composite, and thus the volume fraction of the ceramic compact in the metal matrix composite can be reduced, which in turn increases the total volume of hollow spaces formed inside the spherical cells. As a result, the hollow spaces, as thus increased in volume, of the spherical cells allow the ceramic compact to be easily impregnated with the molten metal, so that the mechanical strength and shock resistance of the ceramic compact can be improved. The volume fraction of the ceramic compact in the metal matrix composite may more preferably be in a range of 15 to 30%.

In the above cylinder block, the ceramic compact may be configured to include one of silicon carbide (SiC), silicon nitride ($Si_3N_4$), alumina ($Al_2O_3$) and aluminum nitride (AlN). This configuration may serve to achieve some of several advantages. For example, if the ceramic compact is made of silicon carbide, the resulting metal matrix composite can be of high thermal conductivity, high strength, high rigidity, high resistance to abrasion, and low coefficient of thermal expansion. If the ceramic compact is made of silicon nitride, the resulting metal matrix composite can be of high strength, high rigidity, high resistance to abrasion, and low coefficient of thermal expansion. If the ceramic compact is made of alumina, the resulting metal matrix composite can be of high strength, high rigidity, high resistance to abrasion, and low coefficient of thermal expansion. If the ceramic compact is made of aluminum nitride, the resulting metal matrix composite can be of high thermal conductivity, high strength, high rigidity, high resistance to abrasion, and low coefficient of thermal expansion.

In one embodiment of the present invention, the at least one member made of the metal matrix composite may include a cylindrical body which allows a head bolt to be inserted therethrough into the cylinder block when a cylinder head is fastened to a deck surface of the cylinder block.

According to this embodiment, the cylindrical body is made of a metal matrix composite as described above comprising a ceramic compact having a plurality of spherical cells, and a metal with which the spherical cells are filled. When the metal matrix composite is manufactured, a molten metal is supplied to infill each of the spherical cells therewith, and permeates every spherical cell through the communicating pores. Therefore, the metal matrix composite becomes a member having a higher rigidity, higher thermal conductivity and/or lower coefficient of thermal expansion. To be more specific, the cylindrical body made of such a metal matrix composite is adapted to have the metal bound with the spherical cells of the ceramic compact that are higher in rigidity than the metal and thus serve to enhance and reinforce the cylindrical body as a whole, so as to achieve a higher rigidity of the cylindrical body; the cylindrical body is adapted to include the ceramic compact made of ceramics (spherical cells) that is higher in thermal conductivity than the metal and thus allows heat to be transferred through the ceramics rather than the metal, so as to achieve a higher thermal conductivity of the cylindrical body as a whole; and the cylindrical body is adapted to have the metal bound with the spherical cells that are lower in coefficient of thermal expansion than the metal and thus serve to reduce the coefficient of thermal expansion of the cylindrical body as a whole, so as to achieve a lower coefficient of thermal expansion of the cylindrical body.

In this metal matrix composite, the metal is bound with the spherical cells and the thermal expansion of the metal progresses uniformly in all the spherical cells. Therefore, the cylindrical body made of the metal matrix composite exhibits a uniformly lowered coefficient of thermal expansion of the metal in all the spherical cells, so that the increase in axial fastening force applied to the head bolt can be checked or minimized. The head bolt is inserted through the cylindrical body made of the metal matrix composite into the cylinder block when a cylinder head is fastened to the deck surface of the cylinder block. Consequently, the coefficient of thermal expansion of the cylindrical body can be made substantially equal to that of the head bolt inserted therethrough, so that the increase in the axial fastening force applied to the head bolt under high temperature conditions can be reduced.

In this embodiment, the cylindrical body may be disposed at the deck surface to define an opening and a portion adjacent thereto of a bolt hole of the cylinder block, and at least a midsection of the head bolt may be disposed inside the cylindrical body when the head bolt is applied with an external thread portion thereof screwed in and engaged with an internal thread portion formed in an interior of the cylinder block. In this construction, preferably but not necessarily, an inside diameter of the cylindrical body may be larger than a minor diameter of the internal thread portion by 10% or more. According to this construction, the bolt hole through which the head bolt is to be inserted is comprised of the portion adjacent to the opening at the deck surface, which portion is formed of the cylindrical body, and the internal thread portion formed in the interior of the cylinder block. Therefore, the portion of the bolt hole formed of the cylindrical body may thermally expand to substantially the same extent as the head bolt does due to the heat generated in the engine. Consequently, the head bolt and the cylindrical body through which the head bolt is inserted into the cylinder block are subject to substantially the same thermal expansion such that the expansions in the axial directions thereof occur in equal degrees, whereby the increase in the axial fastening force applied to the head bolt can be checked or minimized. For example, even when changes in temperature of the cylinder block associated with the operation of the engine causes the cylinder block to expand or contract, the axial fastening force of the head bolt is not subject to appreciable change, so that the sealing capability established at the deck surface can be maintained. In a case where the inside diameter of the cylindrical body is larger than the minor diameter of the internal thread portion by 10% or more, the internal thread portion can be formed with increased ease in the interior (i.e., deep inside the recess, behind the cylindrical body made of metal matrix composite that is difficult to work) of the cylinder block.

The cylindrical body may preferably but not necessarily be adapted to have a part of an outer cylindrical surface thereof constituting a part of an inner wall of a water jacket. This construction serves to inhibit the cylindrical body from becoming hot due to the heat generated in the engine and thermally expanding, and to inhibit the axial fastening force applied to the head bolt from increasing, thereby making it possible to provide a cylinder block in which the axial fastening force applied to the head bolt is not likely to change irrespective of fluctuation in temperature.

In another embodiment of the present invention, the at least one member made of the metal matrix composite may include a cylinder liner.

According to this embodiment, the cylinder liner is made of a metal matrix composite as described above comprising a ceramic compact having a plurality of spherical cells, and a metal with which the spherical cells are filled. When the metal matrix composite is manufactured, a molten metal is supplied to infill each of the spherical cells therewith, and permeates every spherical cell through the communicating pores. Therefore, the metal matrix composite becomes a member having a higher rigidity, higher thermal conductivity and/or lower coefficient of thermal expansion. To be more specific, the cylinder liner made of such a metal matrix composite is adapted to have the metal bound with the spherical cells of the ceramic compact that are higher in rigidity than the metal and thus serve to enhance and reinforce the cylinder liner as a whole, so as to achieve a higher rigidity of the cylinder liner; the cylinder liner is adapted to include the ceramic compact made of ceramics (spherical cells) that is higher in thermal conductivity than the metal and thus allows heat to be transferred through the ceramics rather than the metal, so as to achieve a higher thermal conductivity of the cylinder liner as a whole; and the cylinder liner is adapted to have the metal bound with the spherical cells that are lower in coefficient of thermal expansion than the metal and thus serve to reduce the coefficient of thermal expansion of the cylinder liner as a whole, so as to achieve a lower coefficient of thermal expansion of the cylinder liner.

In the cylinder block of which a cylinder liner is made of a metal matrix composite, the cylinder liner is high in rigidity or in other aspects of mechanical strength. Since the cylinder block according to the present embodiment includes such a cylinder liner having a high mechanical strength (e.g., rigidity, etc.), the rigidity/strength of the cylinder liner is higher than that of the conventional cylinder liner made of cast iron or stainless steel, and thus the use of the cylinder block according to the present embodiment makes it possible to manufacture an engine having an increased output power without design changes which would require increase in dimension of the engine.

Further, according to this embodiment, advantages that may be brought about to the engine as a whole are as follows:

(1) the rigidity of the portion around the bore of the cylinder block can be improved, and the sealing capability for preventing a leak of combustion gases can be improved;

(2) the thermal conductivity of the portion around the bore of the cylinder block can be improved, and the portion around the bore of the cylinder block can be allowed to swiftly cool down;

(3) the thermal expansion of the portion around the bore of the cylinder clock can be reduced, and even when the cylinder block expands and contracts due to change in temperature resulting from operation of the engine, the increase in clearance between the cylinder liner and the piston reciprocating inside the cylinder liner, which would be caused by the thermal expansion of the cylinder liner under high temperature conditions, can be checked or minimized; thus, the unsteadily swaying motion of the piston, and the resulting noises and vibrations, can be prevented; further, the piston ring can be prevented from widening and loosening, so that the oil can be prevented from being wasted and deteriorated.

The above cylinder liner may preferably but not necessarily be disposed between the water jacket and the bore. According to this arrangement, since the cylinder liner made of the metal matrix composite is disposed between the water jacket and the bore, the thermal conductivity of the portion around the bore of the cylinder block is further improved and the portion around the bore is allowed to cool down more swiftly. Moreover, the thermal expansion of the portion around the bore of the cylinder block can be further reduced, so that even when the cylinder block expands and contracts due to change in temperature resulting from operation of the engine, the increase in clearance between the cylinder liner and the piston reciprocating inside the cylinder liner, which would be caused by the thermal expansion of the cylinder liner under high temperature conditions of the engine, can be checked or minimized.

A water jacket may preferably but not necessarily be formed in the above cylinder liner. According to this construction, the water jacket formed in the cylinder liner serves to check a rise in temperature and an associated thermal expansion of the cylinder liner due to the heat of the engine, as well as the increase in the clearance between the cylinder liner and the piston under high temperature conditions. Consequently, a cylinder block that has a clearance between the cylinder liner and the piston kept constant and a sealing capability exhibited irrespective of the changes in temperature can be provided.

In still another embodiment of the present invention, the at least one member made of the metal matrix composite may include a water jacket.

In still another embodiment of the present invention, the above cylinder block may be molded of the metal with which the ceramic compact are filled whereby the cylinder block and the at least one member made of the metal matrix composite are of monolithic construction. The monolithic construction of the cylinder block allows the borders or interfaces between the at least one member and the cylinder block to be removed so that the strength and the thermal conductivity can be improved.

In another aspect of the present invention, there is provided a process for manufacturing a cylinder block. The process comprises: providing a ceramic compact shaped in a predetermined form with a three-dimensional mesh structure comprised of a plurality of spherical cells and a plurality of communicating pores for allowing adjacent spherical cells to communicate with each other; placing the ceramic compact at a predetermined position in a mold; and supplying a metal material into the mold.

It is also one aspect of the present invention to provide a cylinder block manufactured by the above process.

According to some of the above-described embodiments of the present invention, the increase in axial fastening force applied to the head bolt, which would be caused by change in temperature of the engine, can be checked or minimized, so that a cylinder block in which the axial fastening force applied to the head bolt can be maintained irrespective of change in temperature of the engine (whether the engine is under high temperature conditions or under low temperature conditions) can be provided. According to some of the above-described embodiments of the present invention, a cylinder block which exhibits a high thermal conductivity, high rigidity and low coefficient of thermal expansion, and lends itself to use for a lightweight, compact and high output power engine, can be provided without sacrificing the slidability required for the bore.

BRIEF DESCRIPTION OF THE DRAWINGS

The above aspects, other advantages and further features of the present invention will become more apparent by describing in detail illustrative, non-limiting embodiments thereof with reference to the accompanying drawings, in which.

DETAILED DESCRIPTION OF THE EXEMPLARY EMBODIMENTS

A detailed description will be given of exemplary embodiments of a cylinder block according to the present invention with reference to the drawings.

The cylinder block consistent with the present invention may be incorporated in an internal combustion engine of any forms and types, as exemplified by an in-line four-cylindered engine; the following discussion will be directed to a cylinder block of the in-line four-cylindered engine for conveniences' sake. It is however to be understood that the internal combustion engine to which the cylinder block consistent with the present invention is adopted is not limited to this or any particular form or type of the internal combustion engine.

[First Embodiment]

Figure 1:
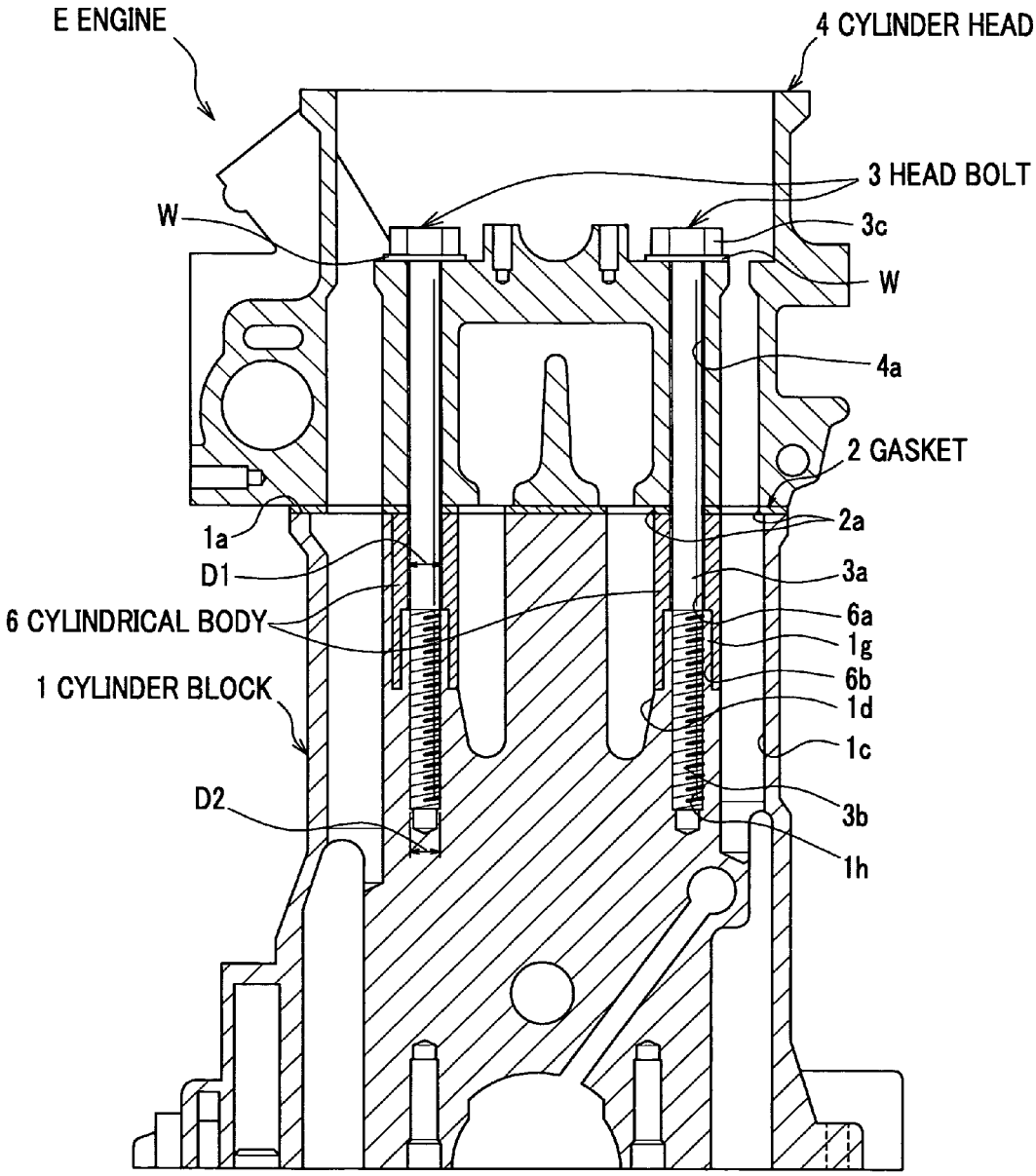
FIG. 1 is a sectional view showing a cylinder block according to a first embodiment of the present invention, to which a cylinder head is fastened using head bolts.
Figure 2:
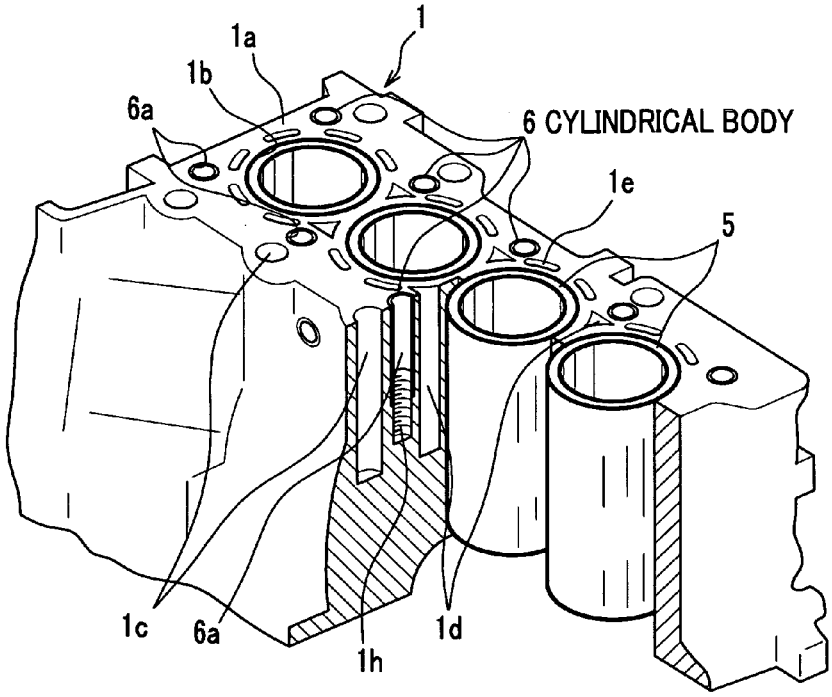
FIG. 2 is a partially cutaway perspective view of the cylinder block according to the first embodiment of the present invention.
Figure 3:
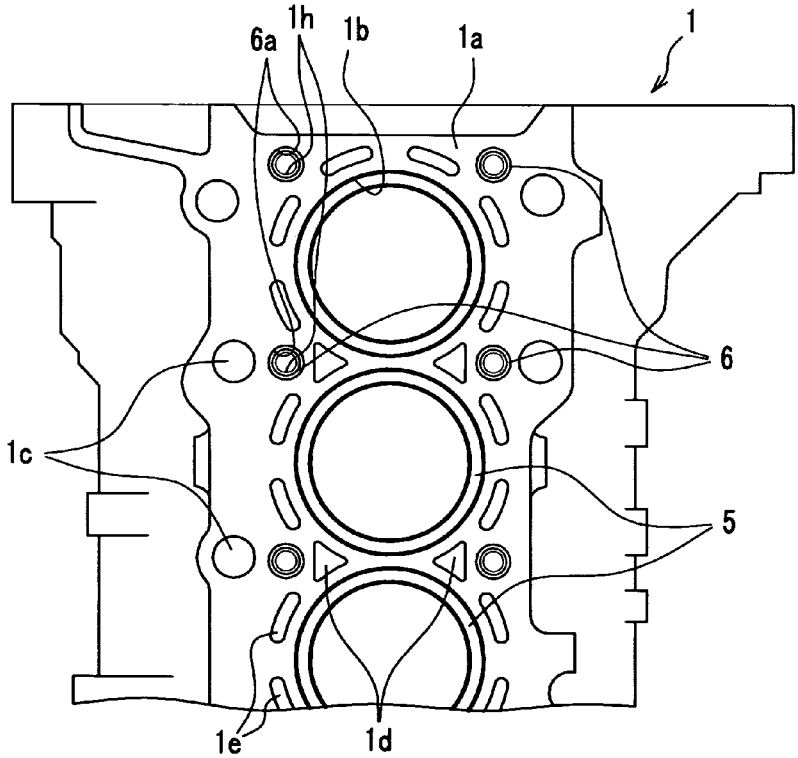
FIG. 3 is a plan view showing a principal portion of the cylinder block shown in FIG. 2.

Referring now to FIGS. 1–3, a description will be given of a cylinder block according to a first embodiment of the present invention, to which a cylinder head is to be fastened using head bolts. In the first embodiment of the present invention, a portion of the cylinder block around each bolt hole thereof for a head bolt to be inserted therethrough is formed of a metal matrix composite (MMC) that will be described later in detail. In the following description of the present embodiment, the portion formed of the metal matrix composite will be called "cylindrical body".

<Engine>

As shown in FIG. 1, an engine E includes a cylinder block 1, and a cylinder head 4 fastened to a top face (deck surface 1*a*) of the cylinder block 1 using a plurality of head bolts 3 with a gasket 2 placed between the cylinder head 4 and the cylinder block 1.

Further provided in the engine E are a head cover (not shown) disposed over a top face of the cylinder head 4, and a lower case (not shown) disposed beneath the cylinder block 1 and an oil pan (not shown) disposed beneath the lower case.

<Cylinder Block>

The cylinder block 1 is, as will be described later in detail, molded of a metal 12 (see FIG. 5) such as an aluminum alloy with which ceramic compacts 7 (preforms of cylindrical bodies 6; see also FIG. 4) are filled, so that the cylinder block 1 and the cylindrical bodies 6 are of monolithic construction. The cylinder block 1 is made by placing cylinder liners 5 and the ceramic compacts 7 as inserts in a mold and pouring the metal 12 in the mold. At the deck surface 1*a* of the cylinder block 1 are arranged, for example, four in-line barrel holes 1*b* an inside of which are lined with the cylinder liners 5, ten bolt holes 6*a* defined by the cylindrical bodies 6 arranged around the barrel holes 1*b*, and water jackets 1*d*, 1*e* provided around the barrel holes 1*b*, which are flush with one another at the deck surface, as shown in FIGS. 2 and 3.

(Water Jacket)

The water jackets 1*d*, 1*e* are fluid passages provided around the cylinder liners 5 (see FIG. 2) and coupled together in an interior of the cylinder block 1, for circulating a coolant in the cylinder block 1 and the cylinder head 4 to prevent pistons (not shown) from sticking to the cylinder liners 5 and seizing up by heat.

The water jackets 1*d*, 1*e* are spaced at substantially regular intervals around the cylinder liners 5 in order to efficiently and effectively cool the cylinder liners 5 and the cylindrical bodies 6 as well as the cylinder block 1 as a whole.

Each of the water jackets 1*d* is shaped substantially like a triangle as viewed from above, and disposed at both sides of a small spacing between adjacent cylinder liners 5 that are aligned in a row and spaced at relatively short intervals. Walls of each water jacket 1*d* are partially or entirely made up of two cylinder liners 5 and one cylindrical body 6 adjacent thereto; in other words, part of outer cylindrical surfaces of the cylinder liners 5 and the cylindrical body 6 constitute at least part of inner walls of the water jackets 1*d*.

Each of the water jackets 1*e* is shaped substantially like an oval or oblong FIG. as viewed from above, and disposed around the cylinder liners 5. At an outside of each water jacket 1*e* is provided a through hole 1*c* for passing oils circulated in the cylinder head 4 downward in the cylinder block 1.

<Gasket>

As shown in FIG. 1, the gasket 2 is a member for packing the piston and sealing a joint between the cylinder block 1 and the cylinder head 4 so that gas cannot escape, and also called "cylinder head gasket". The gasket 2 is made, for example, of a plurality of steel sheets stacked to achieve a cushioning effect, and has holes 2*a* aligned with the bolt holes 4*a*, 6*a*, the water jackets 1*d*, 1*e* and the through holes 1*c*, respectively.

<Head Bolt>

Adopted as each head bolt 3 is a commonly used hexagon head bolt made of steel, which includes a hexagonal head portion 3*c*, an external thread portion 3*b* having an outside surface thereof on which a screw thread is cut, and a shank portion 3*a* having a smooth cylindrical surface without a screw thread cut thereon which shank portion is provided between the head portion 3*c* and the external thread portion 3*b*.

When the cylinder head 4 is fastened to the deck surface 1*a* of the cylinder block 1, the external thread portion 3*b* of each head bolt 3 is inserted through a metal washer W into the bolt hole 4*a* of the cylinder head 4, passing through the hole 2*a* of the gasket 2, and allowed to enter the bolt hole 6*a* of the cylindrical body 6, so that the head bolt 3 is tightened up with the external thread portion 3*b* thereof screwed in and engaged with an internal thread portion 1*h* formed in an interior of the cylinder block 1. In an alternative embodiment, the head bolt 3 may be a preassembled screw and washer combination, or "sems" in which the washer W is integrated with the head portion 3*c*.

<Cylinder Head>

The cylinder head 4 as shown in FIG. 1, like the cylinder block 1, is formed for example by die casting of metal 12 (see FIG. 5) such as an aluminum alloy that is light in weight and excellent in heat dissipating characteristics. The cylinder head 4 is placed on the gasket 2 placed on the deck surface 1*a* of the cylinder block 1. The head bolts 3 are inserted from above into the bolt holes 4*a* of the cylinder head 4, and the external thread portion 3*b* is screwed in and engaged with the internal thread portion 1*h* formed in the interior of the cylindrical block 1, while the shank portion 3*a* of each head bolt 3 is located inside the bolt hole 4*a* of the cylinder head 4, the hole 2*a* of the gasket 2, and the bolt hole 6*a* of the cylindrical body 6 that are aligned with one another, respectively, whereby the cylinder head 4 is tightly fastened to the cylinder block 1.

In the cylinder head 4, a combustion chamber (not shown) is formed, and a plug and a valve mechanism are provided, though not illustrated.

<Cylinder Liner>

As shown in FIG. 2, each of the cylinder liners 5 is a cylindrical member which allows a piston (not shown) to reciprocate inside, and also called "cylinder sleeve". The cylinder liners 5 may be made of high-rigidity castings or formed of the same metal 12 (see FIG. 5) as used in the cylindrical body 6 that will be described later, and integrated with the cylinder block 1.

<Cylindrical Body>

As shown in FIG. 1, the cylindrical bodies 6 constitute bolt housings in the cylinder block 1, and each include a bolt hole 6*a* and a major diameter portion 6*b*. The bolt hole 6*a* allows the external thread portion 3*b* of the head bolt 3 to pass therethrough into the interior of the cylinder block 1 and the shank portion 3*a* of the head bolt 3 to be inserted and placed therein when the head bolt 3 is applied to fasten the cylinder head 4 to the cylinder block 1. The major diameter portion 6*b* is formed to be fitted on a cylindrical portion 1*g* formed around an open-end side portion of the inner thread portion 1*h*. To form the cylindrical bodies 6, a ceramic compact 7 (see FIG. 5) preformed into a cylindrical shape for each cylindrical body 6 is placed as an insert in a mold, and the metal 12 such as an aluminum alloy is poured into the mold, to thereby infill the spherical cells 8 of the ceramic compact 7 with the metal 12 (see FIG. 5), so that the cylindrical bodies 6 become integral parts of the cylinder block 1. Each cylindrical body 6 is adapted to have an inside diameter D1 (at the bolt hole 6*a*) larger than a minor diameter of the internal thread portion 1*h* by 10% or more. Each cylindrical body 6 is located between the water jacket 1*d* and the water jacket 1*e*, with an upper portion thereof disposed to be flush with the deck surface 1*a* and a lower portion disposed adjacent to the open end (bolt-receiving end) of the internal thread portion 1*h*. In this embodiment, the major diameter portion 6*b* of the cylindrical body 6 overlaps the cylindrical portion 1*g* formed around the internal thread portion 1*h*. The cylindrical bodies 6 are each made of a composite material of which the coefficient of thermal expansion is substantially equal to that of the head bolts 3 made of steel and lower than that of the cylinder block 1. The cylindrical bodies 6 are provided in order to prevent portions around the shank portions 3*a* of the head bolts 3 from thermally expand and to thereby check or minimize the increase in axial fastening force of the head bolts 3 (see FIG. 1). The cylindrical bodies 6 are made of a metal matrix composite 11, of which a detailed description will be given later, that includes a ceramic compact 7 having a three-dimensional mesh structure 10 comprised of a plurality of spherical cells 8 and a plurality of communicating pores 9 for allowing adjacent spherical cells 8 to communicate with each other, with the plurality of spherical cells 8 filled with a metal 12 (see FIG. 5).

The cylindrical body 6 (metal matrix composite 11) is referred to by the term "cylindrical" for the sake of convenience, which could sound as if it would appear visually "cylindrical" in the cylinder block 1; however, the cylindrical body 6 is made as will be described later, by infilling the ceramic compact 7 as a cylindrically shaped preform with the metal 12 so that the cylindrical body 6 and the cylinder block 1 are of monolithic construction, and thus no border or interface appears therebetween in actuality (see FIG. 5).

The metal matrix composite 11 according to the present embodiment will hereinafter be described in detail.

<Ceramic Compact>

Figure 4:
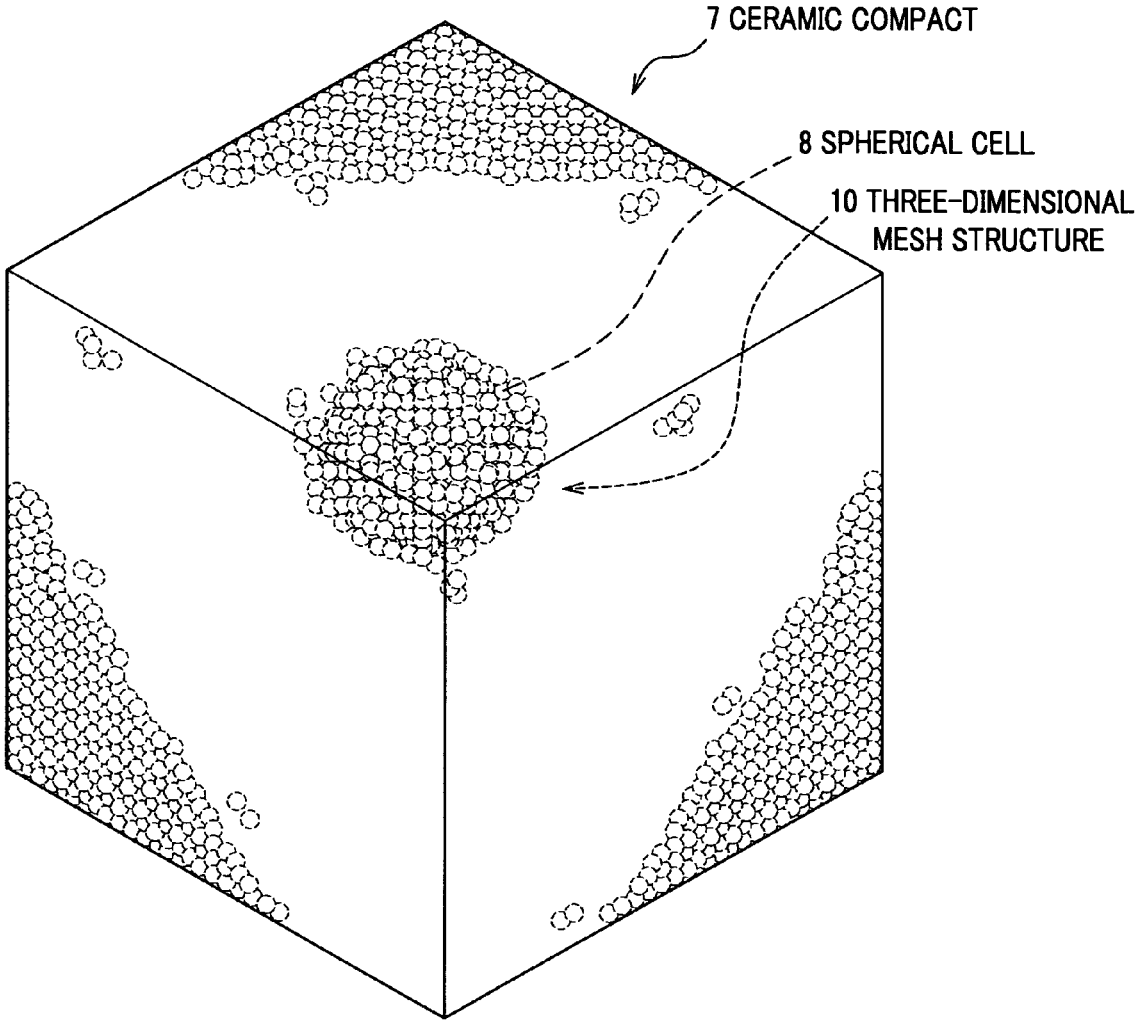
FIG. 4 is a diagram illustrating a ceramic compact for use in a cylinder block according to an exemplary embodiment of the present invention.

FIG. 4 schematically shows a ceramic compact 7 making up the metal matrix composite 11 used in the cylinder block 1 according to the present embodiment.

The ceramic compact 7 is made of a material having a three-dimensional mesh structure 10, and, in this embodiment, is formed to have the same shape as of the resulting cylindrical body 6 as illustrated in FIG. 2. As shown in FIG. 4, inside the ceramic compact 7 are formed a plurality of spherical cells 8. The ceramic compact 7 is, for example, made of silicon carbide (SiC); other engineering ceramics such as alumina ($Al_2O_3$), silicon nitride ($Si_3N_4$) and aluminum nitride (AlN) may be used.

(Spherical Cells)

Figure 5:
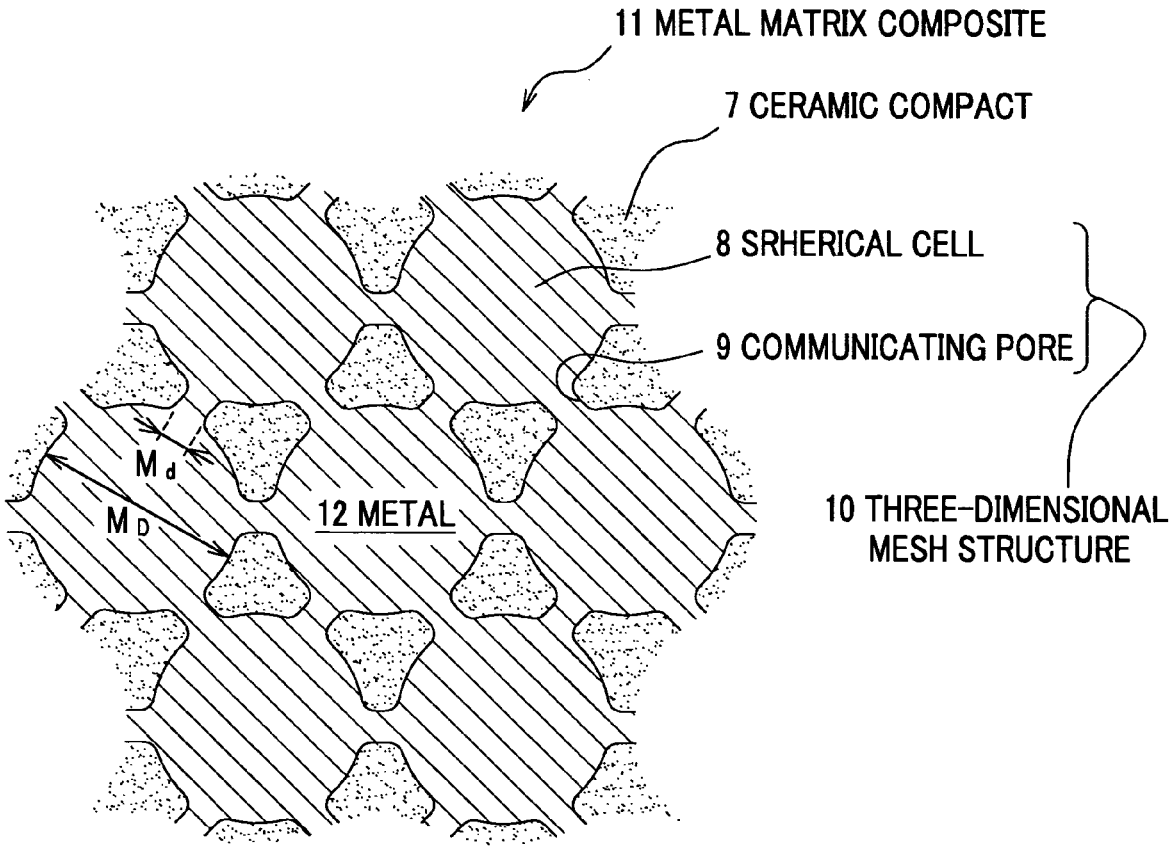
FIG. 5 is a diagram illustrating a metal matrix composite, as made with the ceramic compact as shown in FIG. 4.

FIG. 5 schematically shows a metal matrix composite 11 manufactured with the ceramic compact 7 of FIG. 4.

As shown in FIG. 5, the spherical cells 8 are portions that will be filled with the metal 12 when the metal matrix composite 11 as will be described later is made using the ceramic compact 7, and are shaped like spherical bubbles having substantially uniform inside diameters. The spherical cells 8 are, for example, arranged to form a closest packed structure in the ceramic compact 7, and thus each spherical cell 8 is closely or densely and evenly arranged in the ceramic compact 7.

(Communicating Pores)

As shown in FIG. 5, the communicating pores 9 for allowing adjacent spherical cells 8 to communicate with each other are provided to allow a molten metal 12 to permeate therethrough and become distributed over all the spherical cells 8, when the metal matrix composite 11 is made using the ceramic compact 7. The inside diameters of the communicating pores 9 may be determined according to the inside diameters of the adjacent spherical cells 8. A ratio ($M_d/M_D$) of a median ($M_d$) of the inside diameters of the communicating pores 9 to a median ($M_D$) of the inside diameters of the spherical cells 8 may preferably be configured to be lower than 0.5. Such configuration of the inside diameters of the communicating pores 9 in the ceramic compact 7 serves to reduce the coefficient of thermal expansion of the metal matrix composite 11.

(Metal Matrix Composite)

As shown in FIG. 5, the metal matrix composite 11 is a material composed of a ceramic compact 7 as described above having spherical cells 8 and communicating pores 9 filled with metal 12. In the metal matrix composite 11, the metal 12 in each spherical cell 8 is shaped into a spherical figure having a uniform diameter, and is bound with the spherical cell 8. These spherically shaped metals 12 are distributed over the metal matrix composite 11 so that they are arranged in a closest packed structure. A volume fraction (Vf) of the ceramic compact 7 in the metal matrix composite 11 is configured to fall in a range of 10 to 40%.

(Metal)

The metal 12 is a material to be poured into the ceramic compact 7 to complete the metal matrix composite 11, as well as to be used to form the cylinder block 1. As shown in FIG. 5, the metal 12 with which the spherical cells 8 are filled permeates the metal matrix composite 11 throughout.

In the metal matrix composite 11 made with the ceramic compact 7 of which the ratio ($M_d/M_D$) of the median ($M_d$) is lower than 0.5, a ratio of a median of the diameters of the metal 12 contoured in the communicating pores 9 to a median of the diameters of the metal 12 contoured in the spherical cells 8 is equal to $M_d/M_D$ as above that is lower than 0.5.

The metal 12 used in the metal matrix composite 11 is, for example, made of an aluminum alloy, but may alternatively be selected from other materials such as aluminum (Al), silicon (Si), silicon alloys, copper (Cu), copper alloys, magnesium (Mg) and magnesium alloys.

<Process for Manufacturing Cylinder Block>

Next, a description will be given of a process for manufacturing a cylinder block with reference to FIG. 6 and other drawing figures as appropriate.

A method of manufacturing a metal matrix composite 11 that may be adopted in the process for manufacturing the cylinder block 1 is not limited to a particular process employing specific means and materials; however, the discussion will be extended on an exemplary embodiment in which an aluminum alloy is used for the metal 12.

(Ceramic Compact Production Process)

Figure 6:
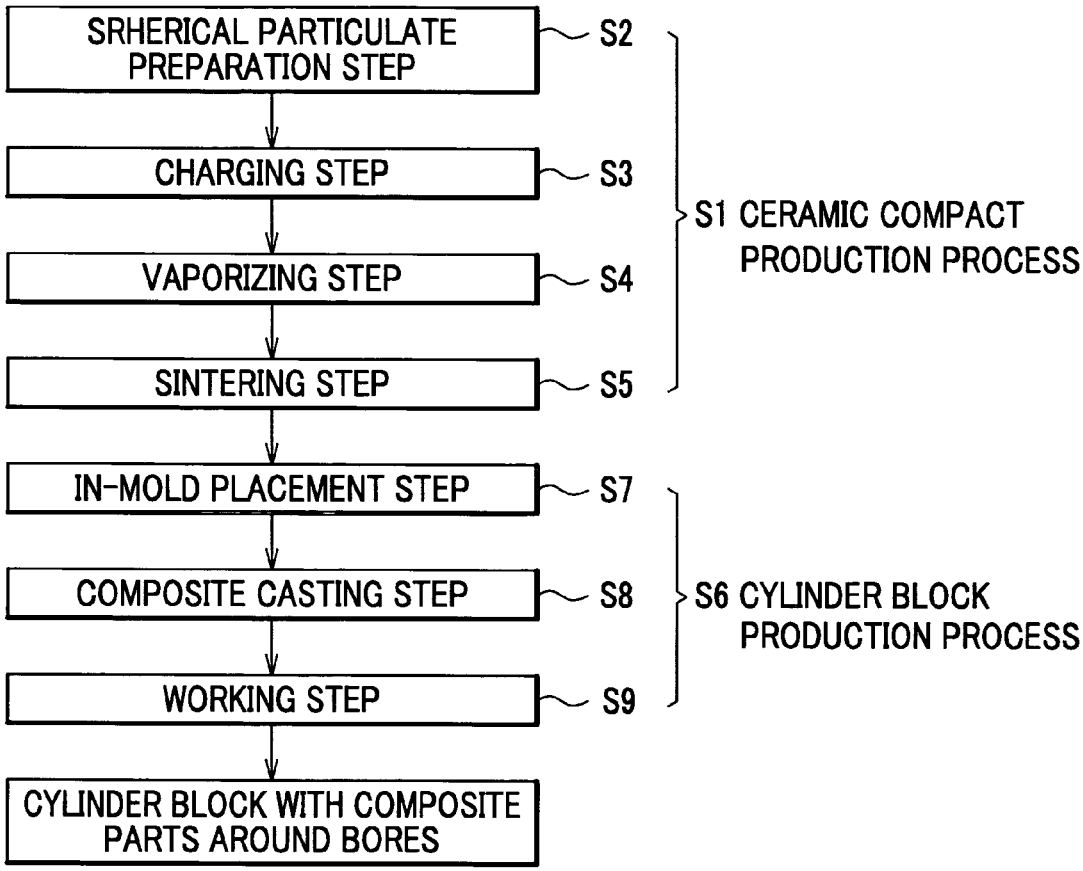
FIG. 6 is a flowchart for explaining process steps of a process for manufacturing a cylinder block according to an exemplary embodiment of the present invention.

FIG. 6 is a flowchart for explaining process steps of the process for manufacturing a cylinder block comprising a metal matrix composite 11 according to an exemplary embodiment of the present invention.

A ceramic compact production process S1 for making a ceramic compact 7 which constitutes a preform of the metal matrix composite 11 is, as shown in FIG. 6, principally comprised of the steps of: preparing spherical particulates to vaporize at a predetermined temperature (spherical particulate preparation step S2); charging the spherical particulates and ceramic grains into a mold (charging step S3); vaporizing the spherical particulates (vaporizing step S4); and sintering the ceramic grains (sintering step S5). The steps S2–S5 will now be described in more detail.

(Spherical Particulate Preparation Step)

The spherical particulates prepared in spherical particulate preparation step S2 are composed of particulates shaped like perfect spheres having diameters of which standard deviation is a predetermined value or smaller. The spherical particulates are made, for example, of resins such as methyl poly(meth)acrylate and polystylene.

(Charging Step)

Figure 7:
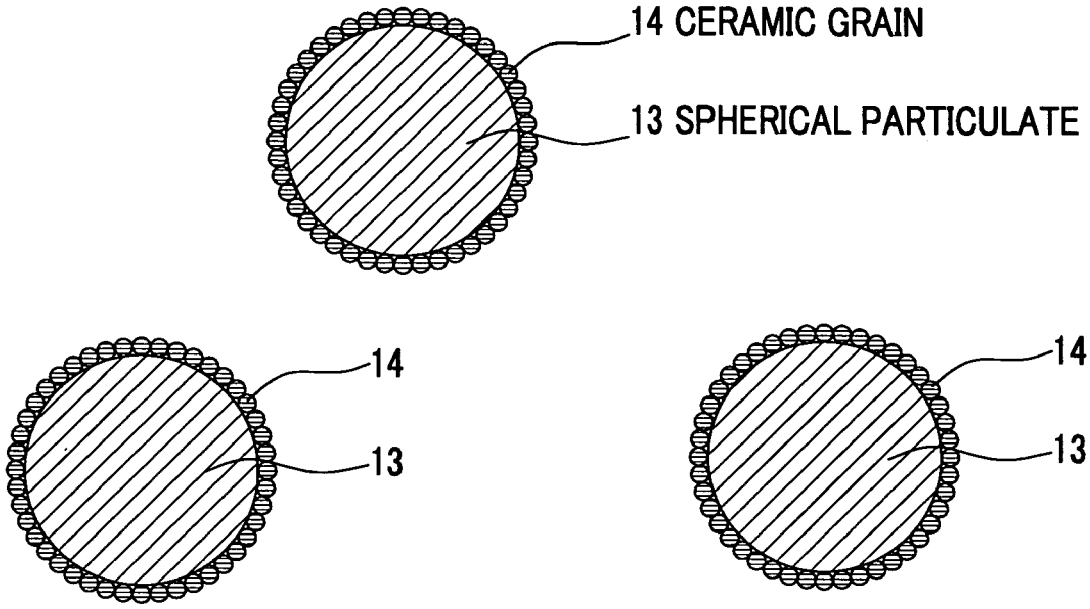
FIG. 7 is a diagram illustrating spherical particulates coated with ceramic grains, as made in a charging step of FIG. 6.

FIG. 7 is a diagram illustrating "spherical particulates coated with ceramic grains", resulting from charging step S3 of FIG. 6.

In charging step S3, as shown in FIG. 7, the ceramic grains 14 shaped like perfect spheres having a uniform diameter and the spherical particulates 13 having a uniform diameter coated with the ceramic grains 14 are charged into the mold. In charging step S3, prior to charging the spherical particulates 13, surfaces of the spherical particulates 13 are covered with the ceramic grains 14. The ceramic grains 14 and ceramic powder 15 that will be described later (see FIG. 8) are made, for example, of silicon carbide (SiC), which is sintered in sintering step S5 later to form a framework of the ceramic compact 7. The ceramic grains 14 and ceramic powder 15 (see FIG. 8) may alternatively be made of other engineering ceramics such as alumina ($Al_2O_3$), silicon nitride ($Si_3N_4$) and aluminum nitride (AlN).

Next, the spherical particulates 13 coated with the ceramic grains 14 are mixed with ceramic slurry to prepare a mixture to be subjected to the subsequent process step. The ceramic slurry is a suspension of the ceramic powder 15 (see FIG. 8) dispersed in a dispersion medium such as water, which can be prepared by mixing the ceramic powder 15 with a dispersion medium using a ball mill or the like. The viscosity of the ceramic slurry may be adjusted to about 0.05 Pa·s to about 5 Pa·s, so that the ceramic slurry (i.e., ceramic powder 15) are distributed evenly and sufficiently over spaces among the spherical particulates 13 coated with the ceramic grains 14.

Figure 8:
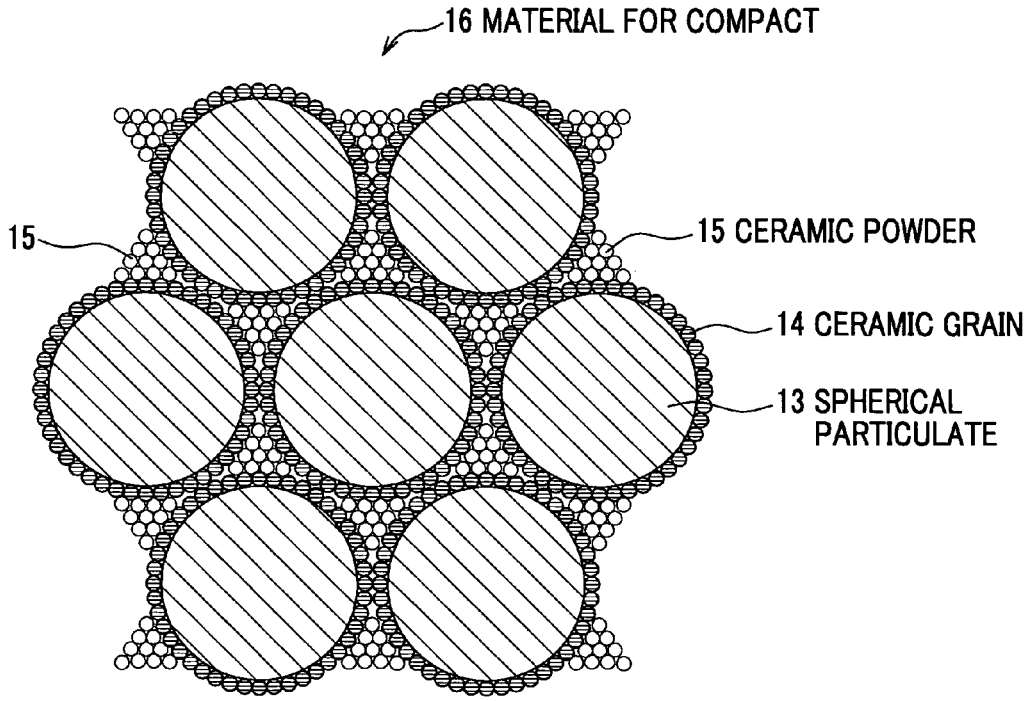
FIG. 8 is a diagram illustrating materials used for making the ceramic compact in the charging step of FIG. 6.

Referring to FIG. 8, which is a diagram illustrating materials for making the ceramic compact 7 in charging step S3 of FIG. 6, the mixture prepared above is poured, for example, into a mold made of a gypsum or like material having a capability of dewatering, and thereby subjected to vacuum filtration in the mold. Accordingly, the liquid component of the mixture, i.e., dispersion medium in the ceramic slurry, is drained out from the mixture. As a result, the materials 16 for making the ceramic compact 7 as shown in FIG. 8 is obtained in which the solid components of the mixture, i.e., "spherical particulates 13 coated with ceramic grains 14", gather together and spaces among "spherical particulates 13 coated with ceramic grains 14" are filled with ceramic powder 15. The materials 16 for the ceramic compact 7 are dried and then subjected to a subsequent treatment in vaporizing step S4.

(Vaporizing Step)

Figure 9:
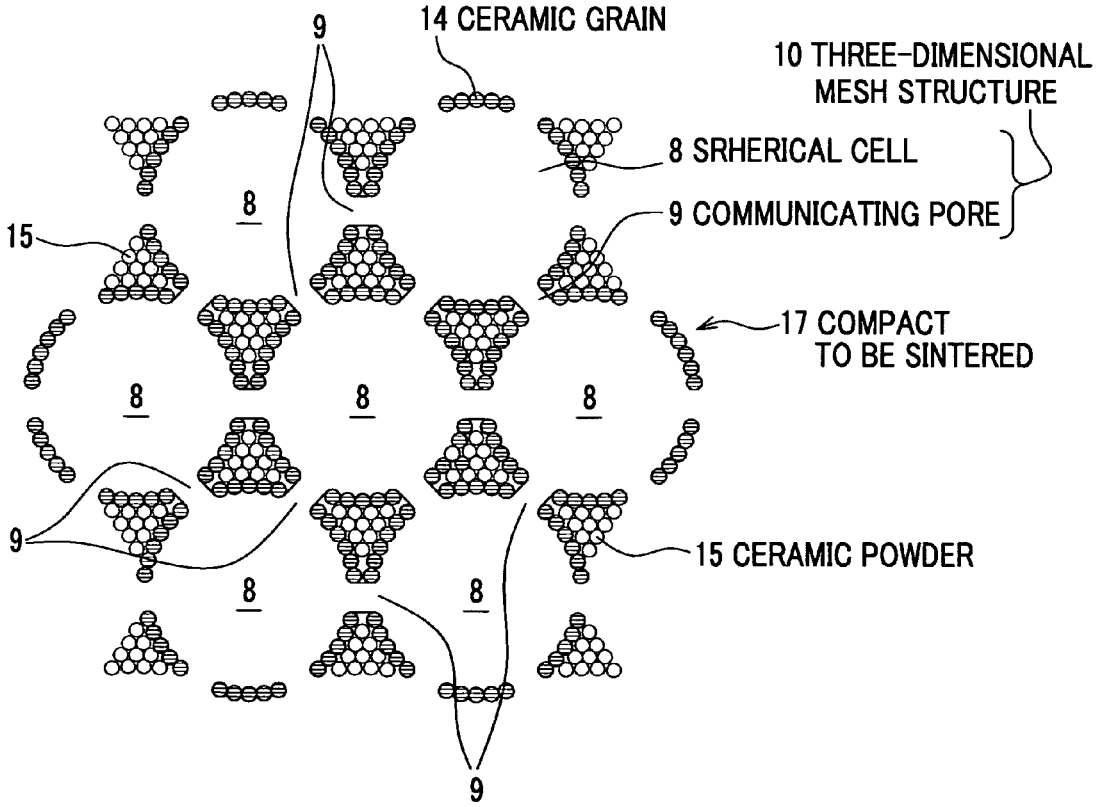
FIG. 9 is a diagram illustrating a compact to be sintered that is made in a vaporizing step and subjected to a sintering step of FIG. 6.

FIG. 9 is a diagram illustrating a compact 17 to be sintered that is formed in vaporizing step S4 of FIG. 6.

In vaporizing step S4, the materials 16 for compact as shown in FIG. 8 are heated in a furnace at a predetermined rate of temperature rise, and thus the spherical particulates 13 in the materials 16 for compact is vaporized. The spaces occupied by the spherical particulates 13 in the materials 16 for compact (see FIG. 8) become hollow spaces as shown in FIG. 9, so that the spherical cells 8 are formed. On the other hand, the gas pressure generated upon vaporization of the spherical particulates 13 allows some ceramic grains 14 having coated the spherical particulates 13 to come off. At this stage of the process, ceramic grains 14 that were stuck on portions nearer in distance between surfaces of adjacent spherical cells 8 come off with a higher priority. As a result, as shown in FIG. 9, the communicating pores 9 for allowing adjacent spherical cells 8 to communicate with each other are formed.

The materials 16 for compact (see FIG. 8) as thus formed with the spherical cells 8 and the communicating pores 9 are used as the compact 17 to be sintered in subsequent sintering step S5.

In the compact 17 to be sintered, a plurality of spherical cells 8 are arranged to form a closest packed structure, and the ceramic grains 14 form a three-dimensional mesh structure 10, as shown in FIG. 9.

(Sintering Step)

In sintering step S5, the compact 17 to be sintered (see FIG. 9) obtained in vaporizing step S4 is sintered. In this sintering step S5, the ceramic grains 14 surrounding the spherical cells 8 and the ceramic powder 15 in the compact 17 to be sintered (see FIG. 9) are sintered into one united body. Consequently, the compact 17 to be sintered becomes a ceramic compact 7 as shown in FIG. 5, and in this embodiment, formed into a cylindrical shape of the cylindrical body 6 as shown in FIG. 6.

(Cylinder Block Production Process)

Next, in cylinder block production process S6, the ceramic compact 7 formed in such a manner as described above is used as a preform of a cylindrical body 6 (metal matrix composite 11) to manufacture a cylinder block 1 integrated with the cylindrical body 6. The cylinder liner 5 and the ceramic compact 7 shaped into the form of the cylindrical body 6 are placed as inserts in a mold, and an aluminum alloy (metal 12) is poured into the mold to form a cylinder block 1 and a cylindrical body 6 embedded therein at the same time. As shown in FIG. 6, the cylinder block production process S6 is principally comprised of in-mold placement step S7, composite casting step S8 and working step S9, through which a cylinder block 1 with composite parts incorporated around the bores (in the present embodiment, around portions where head bolts 3 are fitted) are manufactured. The steps S7–S9 will be described in more detail.

(In-Mold Placement Step)

In in-mold placement step S7, ceramic compacts 7 (see FIG. 5) as preforms of cylindrical bodies 6 shown in FIG. 2, which are made according to the ceramic compact production process S1, as well as cylinder liners 5 formed of the same material as used to form the ceramic compacts 7 or made of any high-rigidity castings, are placed at predetermined positions in the mold, respectively.

(Composite Casting Step)

In subsequent composite casting step S8, an aluminum alloy as a metal 12 which makes up the main body of the cylinder block 1 and with which the spherical cells 8 of the ceramic compact 7 as preforms of the metal matrix composites 11 (cylindrical bodies 6 in the present embodiment) are filled is poured into the mold to form the cylinder block 1 in which the metal matrix composites 11 and the cylinder liners 5 are insert-molded. Accordingly, the metal matrix composites 11, of which the spherical cells 8 are filled with the aluminum alloy (metal 12), and the cylinder liners 5 are formed integrally with the cylinder block 1. The metal matrix composites 11 are embedded in the cylinder block 1 to form one united body such that no interface or border appears therebetween, and thus exhibit high strength, high rigidity, high resistance to abrasion and low coefficient of thermal expansion.

(Working Step)

Next, the cylinder block 1 formed in composite casting step S8 is removed from the mold and cooled; the process then goes to working step S9, in which a tapping work for forming internal thread portions 1*h* and a grinding work to remove burrs formed in the casting step are carried out to finish the final casting. At this stage, since the inside diameter D1 of each cylindrical body 6 is 10% or more larger than a minor diameter D2 of the internal thread portion 1*h*, the internal thread portion 1*h* can be formed with increased ease in the interior (i.e., deep inside the recess, behind the cylindrical body 6 made of metal matrix composite 11 that is difficult to work) of the cylinder block 1. Resultantly, the cylinder block 1 of which portions around bolt holes 6*a* for allowing the head bolts 3 to be inserted therein are made of the metal matrix composite 11 can be manufactured.

<Assembly>

The cylinder block 1 that has been manufactured in such a manner as described above is subjected to an assembly process, in which a gasket 2 is placed on the deck surface 1*a*, a cylinder head 4 is placed on the gasket 2, and head bolts 3 are applied to fasten the cylinder head 4 to the cylinder block 1, as shown in FIG. 1. The shank portion 3*a* of each head bolt 3 is inserted in the bolt hole 6*a* of the cylindrical body 6, and the external thread portion 3*b* of the head bolt 3 is screwed in and engaged with the internal thread portion 1*h* of the cylinder block 1. Thereafter, over the cylinder head 4 is attached a head cover (not shown), and beneath the cylinder block 1 is attached a lower case (not shown) to which an oil pan (not shown) is attached, with the result that the assembly process of the engine E is completed.

<Operation>

When the engine E that has been completed in such a manner as described above is brought into operation, the operation evolves heat. Thus generated heat raises the temperatures of the cylinder block 1, the cylindrical bodies 6 and head bolts 3 thereof, and the cylinder head 4, which are also cooled by the coolant flowing in the water jackets 1*d*, 1*e* formed in the cylinder block 1 and the cylinder head 4, so that the cylinder block 1 and the cylinder head 4 are maintained within a predetermined range of temperatures.

Each cylindrical body 6 is made of a metal matrix composite including a ceramic compact 7 having a three-dimensional mesh structure with a plurality of uniformly distributed spherical cells 8 filled with an aluminum alloy (metal 12), and thus exhibits a higher thermal conductivity, a higher rigidity and a lower coefficient of thermal expansion than those exhibited in cases where the portion around the bolt hole 6*a* corresponding to the cylindrical body 6 is made of the same metal 12 (aluminum alloy) as making up the cylinder block 1. The coefficient of thermal expansion of the cylindrical body 6 is reduced to the level substantially equal to that of head bolt 3 made of steel. The cylindrical body 6 is so high in thermal conductivity that heat may be transferred swiftly; thus, the cylindrical body 6 can be cooled swiftly.

When the head bolt 3 is inserted in the cylindrical body 6 and screwed in and engaged with the internal thread portion of the cylinder block 1, the shank portion 3*a* and the cylindrical body 6 thermally expands equally. Accordingly, the cylindrical body 6 thermally expands in axial directions as much as the head bolt 3 does, so that the increase in axial fastening force applied to the head bolt 3, which may be caused by a rise in temperature of the engine E, can be checked or minimized.

Since the axial fastening force applied to the head bolt 3 does not change considerably, the fastening force between the cylinder block 1 and the cylinder head 4, which is applied to the gasket 2, does not change considerably; therefore, the sealing capability of the gasket 2 at the deck surface 1 can be maintained.

<Advantageous Effects of First Embodiment>

The cylindrical body 6 formed by following the processes S1 (steps S2–S5) and S6 (steps S7–9) brings about at least any one of advantageous effects as follows.

(1) The metal 12 with which the spherical cells 8 are filled assumes spherical shapes as shown in FIG. 5, and thus the metal 12 exhibits no anisotropic property in thermal expansion.

(2) In the cylindrical body 6, the metal 12 is bound with the spherical cells 8 and is distributed densely and uniformly to form a three-dimensional mesh structure 10 of the metal matrix composite 11; thus, the metal 12 contained in the metal matrix composite 11 thermally expands in a uniform manner. Accordingly, the coefficient of thermal expansion of the cylindrical body 6 is lower than those of any conventional metal matrix composites and other materials applicable. For example, the cylindrical body 6 may have a coefficient of thermal expansion lower than the aluminum alloy making up the cylinder block 1, and thus may be adapted to have a coefficient of thermal expansion substantially equal to the coefficient of thermal expansion of the head bolt 3 made of a material having a coefficient of thermal expansion lower than the aluminum alloy; therefore, the increase in axial fastening force applied to the head bolt 3, which may be caused by a rise in temperature of the engine E, can be checked or minimized.

(3) The metal matrix composite 11 making up the cylindrical body 6 has metal 12 in the spherical cells 8 arranged in a closest packed structure, which serves to improve the mechanical strength and shock resistance of the ceramic compact 7, and thus enhancing the mechanical strength of the cylindrical body 6. As a result, the volume fraction Vf of ceramic compact 7 in the metal matrix composite 11 can be reduced so that the metal matrix composite 11 having increased hollow spaces in the spherical cells 8 can be easily impregnated with the molten metal 12.

(4) In cases where the cylindrical body 6 made of metal matrix composite 11 is formed using a ceramic compact 7 in which a ratio ($M_d/M_D$) of a median ($M_d$) of the inside diameters of the communicating pores 9 to a median ($M_D$) of the inside diameters of the spherical cells 8 is adapted to be lower than 0.5, the coefficient of thermal expansion of the metal matrix composite 11 can be further reduced, so that the fastening between the cylinder block 1 and the cylinder head 4 can be achieved with a higher axial fastening force even if a head bolts 3 having the same level of strength are applied.

(5) The cylindrical body 6 is adapted to have an inside diameter D1 larger than a minor diameter D2 of the internal thread portion by 10% or more, and thus the internal thread portion 1*h* can be formed with increased ease in the interior (i.e., deep inside the recess, behind the cylindrical body 6 made of metal matrix composite 11 that is difficult to work) of the cylinder block 1.

(6) The cylindrical body 6 is formed, integrally with the cylinder block 1, by pouring metal 12 into ceramic composite 7 shaped cylindrically as a preform so that no interface or border appears therebetween, and thus exhibit high rigidity, high thermal conductivity and low coefficient of thermal expansion.

It is noted that the present invention is not limited to the above embodiment, and various modifications and changes may be made in the present invention without departing from the spirit and scope thereof.

<Modification Examples>

For example, the above-described embodiment exemplifies a face-centered closest packed structure of the ceramic compact 7 in which the spherical cells 8 are arranged to form a face-centered cubic lattice; the structures of the ceramic compact 7 consistent with the present invention may include a hexagonal closest packed structure and a body-centered closest packed structure. Further, the spherical cells 8 may be arranged in an "amorphous" (random) fashion.

In the above-described embodiment, the ceramic compact 7 is illustrated as having a substantially cubic shape; however, the shape of the ceramic compact 7 consistent with the present invention may be changed according to any desired shape of the metal matrix composite 11 to be manufactured.

In the above-described embodiment, the cylindrical body 6 (metal matrix composite 11) as shown in FIGS. 1 and 2 has been described as a member insert-molded in the cylinder block 1; however, the cylindrical body 6 consistent with the present invention is not limited thereto, but may for example be provided in the cylinder head 4; i.e., the bolt holes 4*a* of the cylinder head 4 may be formed with the cylindrical bodies 6.

The process (S1 plus S6) of manufacturing a cylinder block 1 may be arranged to comprise the steps S2 through S5 by which ceramic compacts 7 as preforms for cylindrical bodies 6 are produced as in the above embodiment, followed by the step of filling the ceramic compacts 7 with metal 12 such as an aluminum alloy to make the metal matrix composite 11 (see FIG. 5) as cylindrical bodies 6 in finished form, before placing them in a mold for the cylinder block 1 in step S7 and pouring the metal 12 to make the cylindrical bodies 6 integrated with the cylinder block 1 in step S8; thereafter working process S9 is carried out as in the above embodiment.

According to this arrangement of the process of manufacturing a cylinder block 1, the cylindrical bodies 6 that have been formed of the metal matrix composite 11 are insert-molded in the cylinder block 1, so that the cylindrical bodies 6 can be provided with a higher strength, higher rigidity, higher thermal conductivity, higher resistance to abrasion and lower coefficient of thermal expansion.

[Second Embodiment]

Referring now to FIGS. 10–14, a description will be given of a cylinder block according to a second embodiment of the present invention, in which cylinder liners are provided. In the second embodiment of the present invention, each of the cylinder liners provided inside bores is formed of a metal matrix composite (MMC). In the drawing figures to which a reference will be made, the same components as in the first embodiment are designated by the same reference characters, and a duplicate description thereof will not be given.

<Cylinder Block>

Figure 10:
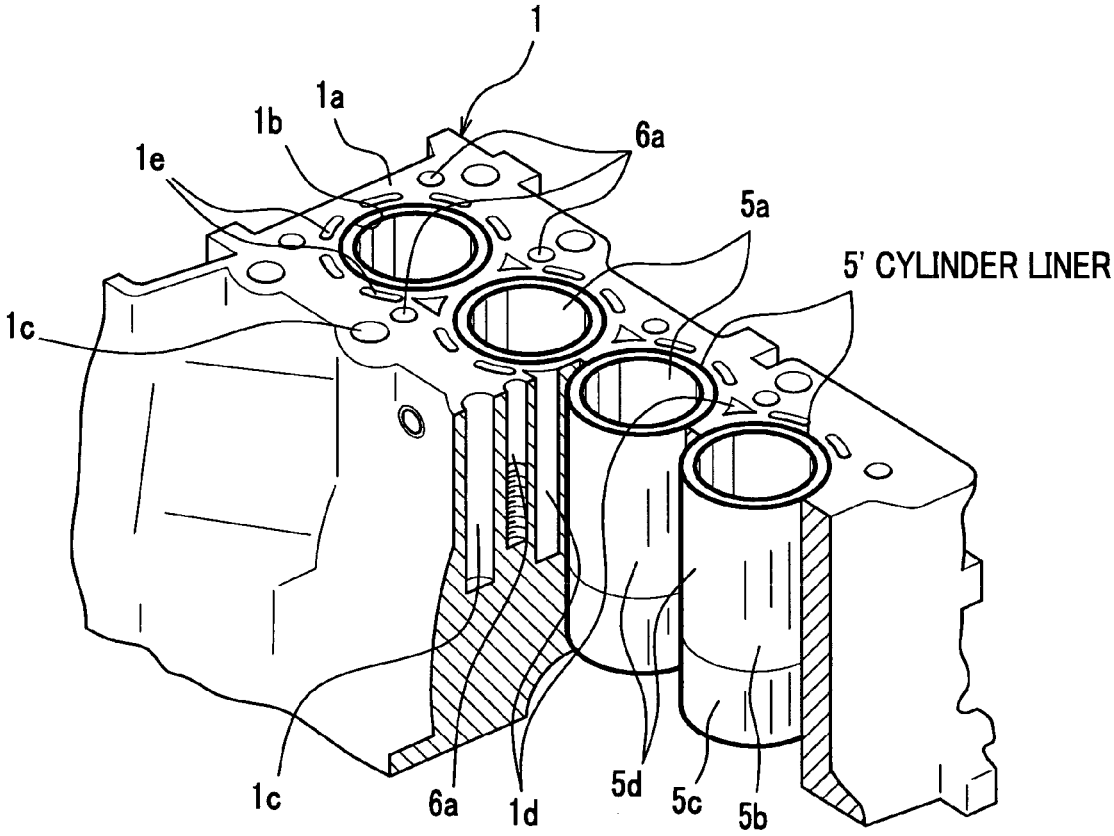
FIG. 10 is a partially cutaway perspective view of a cylinder block according to a second embodiment of the present invention.
Figure 11:
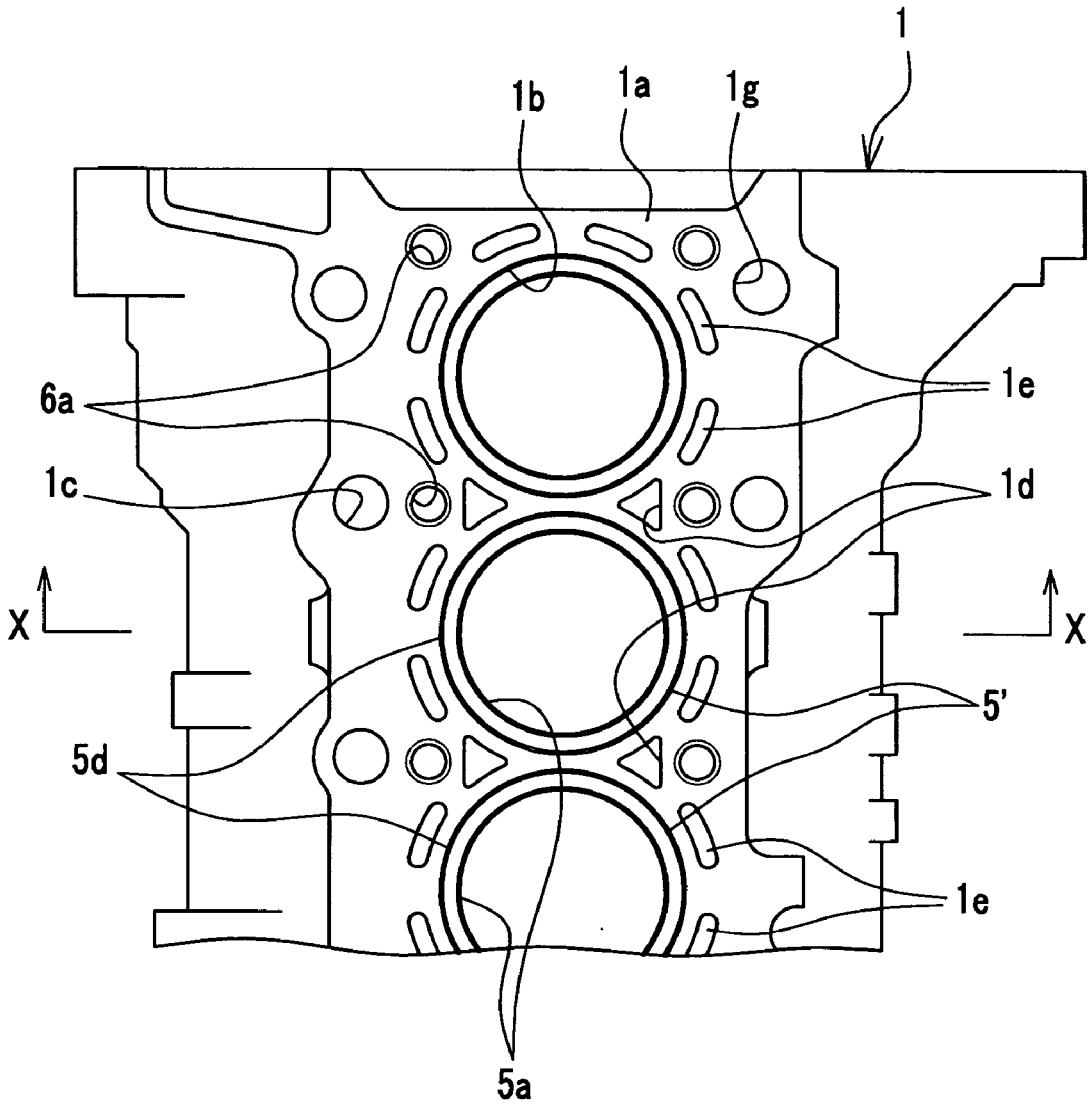
FIG. 11 is a plan view showing a principal portion of the cylinder block shown in FIG. 10.

As shown in FIGS. 10 and 11, the cylinder block 1 is molded of a metal 12 (see FIG. 5) such as an aluminum alloy with which cylindrically shaped ceramic compacts 7 (preforms of cylinder liners 5', see also FIG. 4) are filled, so that the cylinder block 1 and the cylinder liners 5' are of monolithic construction. The cylinder block 1 is made by placing the ceramic compacts 7 as inserts in a mold and pouring the metal 12 in the mold. At the deck surface 1*a* of the cylinder block 1 are arranged, for example, portions corresponding to four in-line barrel holes (hereinafter referred to simply as barrel holes 1*b*) an inside of which are lined with the cylinder liners 5', ten bolt holes 6*a* arranged around the barrel holes 1*b*, and water jackets 1*d*, 1*e* provided around the barrel holes 1*b*, which are flush with one another at the deck surface 1*a*.

The portion corresponding to each barrel hole 1*b* is referred to by the term "barrel hole" for the sake of convenience, which could sound as if the hole 1*b* is visible in the cylinder block 1; however, the cylinder liner 5' is made as will be described later, and attached to the inside of the barrel hole 1*b* by infilling the ceramic compact 7 as a cylindrically shaped preform with the metal 12 so that the cylinder line 5' and the cylinder block 1 are of monolithic construction, and thus no border or interface appears between the cylinder liner 5' and the barrel hole 1*b* in actuality (see FIG. 5).

(Water Jacket)

The water jackets 1*d*, 1*e* (see FIGS. 10, 11) and water jackets 1*f* (see FIG. 12) are fluid passages provided around the cylinder liners 5' and coupled together in an interior of the cylinder block 1, for circulating a coolant in the cylinder block 1 and the cylinder head 4 (see FIG. 1) to prevent pistons P (see FIG. 12) from sticking to the cylinder liners 5' and seizing up by heat.

The water jackets 1*d*, 1*e* are spaced at substantially regular intervals around the cylinder liners 5' in order to efficiently and effectively cool the cylinder block 1 as a whole.

Each of the water jackets 1*d* is shaped substantially like a triangle as viewed from above, and disposed at both sides of a small spacing between adjacent cylinder liners 5' that are aligned in a row and spaced at relatively short intervals. Walls of each water jacket 1*d* are partially made up of parts of two cylinder liners 5'; in other words, part of outer cylindrical surfaces of the cylinder liners 5' constitute at least part of inner walls of the water jackets 1*d*.

Each of the water jackets 1*e* is shaped substantially like an oval or oblong figure as viewed from above, and disposed around the cylinder liners 5'. At an outside of each water jacket 1*e* is provided a through hole 1*c* for passing oils circulated in the cylinder head 4 downward in the cylinder block 1.

Figure 12:
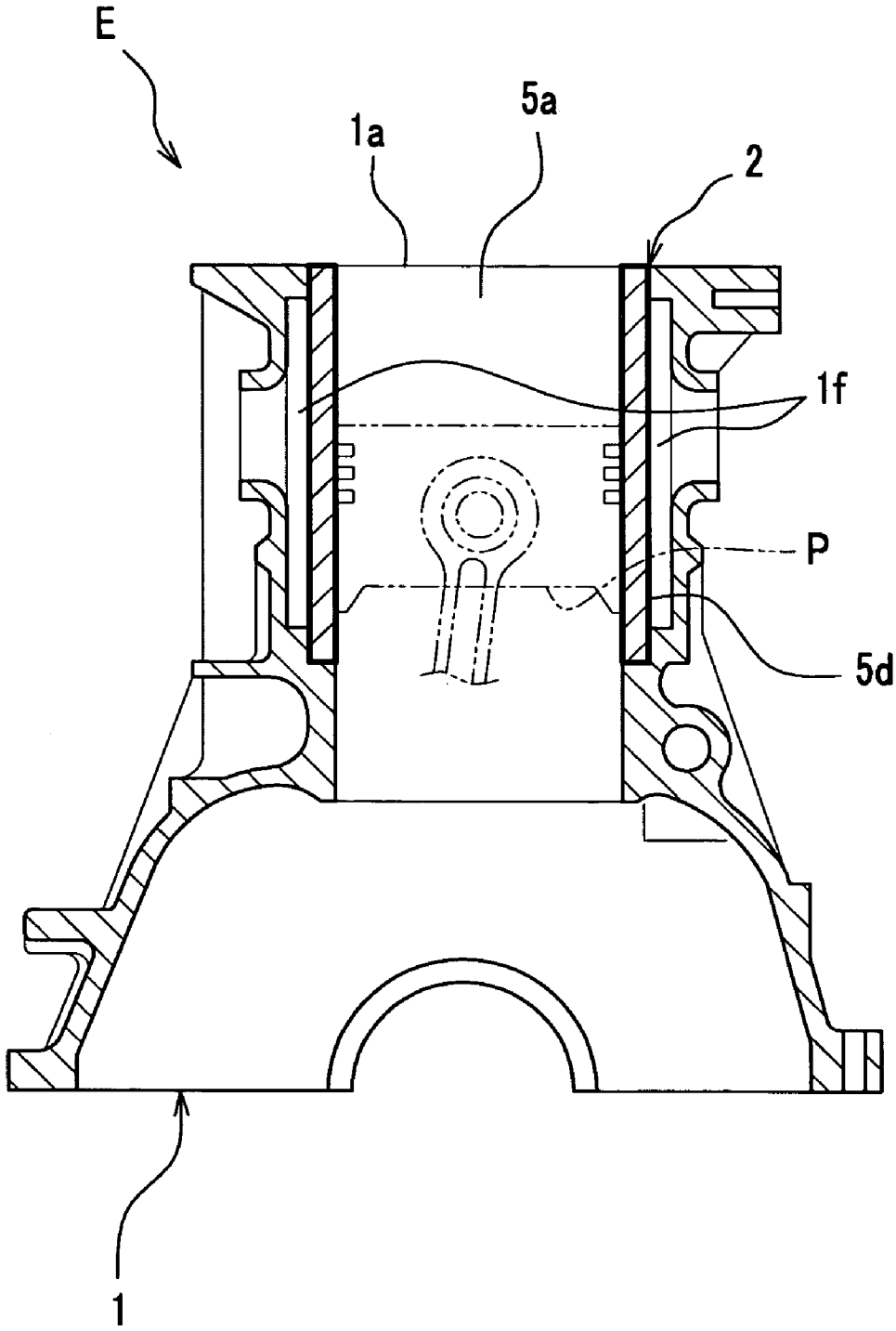
FIG. 12 is a sectional view taken along line X—X of FIG. 11.

Each of the water jackets 1*f* as shown in FIG. 12 is provided around a portion where the piston P reciprocate inside the cylinder liner 5', and formed adjacent to an outer cylindrical surface 5*d* of the cylinder liner 5'; i.e., part of the outer cylindrical surface 5*d* of the cylinder liner 5' constitutes a part of an inner wall of the water jacket 1*f*. In other words, the cylinder liner 5' is disposed between the bore 5*a* and the water jacket 1*f* disposed around the bore 5*a*, so that a coolant is circulated around the cylinder liner 5'.

<Cylinder Liner>

As shown in FIG. 10, each of the cylinder liners 5' is a cylindrical member of which an inside forms a bore 5*a* allowing the piston P to reciprocate, and also called "cylinder sleeve". Each cylinder liner 5' is comprised of a composite portion 5*b* made of a metal matrix composite II (see FIG. 5) and a non-composite portion 5*c*. The cylinder liners 5' are, for example, made by insert molding of four ceramic compacts 7 (see FIG. 4) arranged in a row with a predetermined spacing as preforms of the cylinder liners 5' in a cylinder block 1. The cylinder liners 5' are disposed between the respective bores 5*a* and the water jackets 1*d*, 1*e*, 1*f* (see FIGS. 10–12). The cylinder liners 5' each have the composite portion 5*b* made of the metal matrix composite 11 of which the coefficient of thermal expansion is lower than that of the cylinder block 1 made of an aluminum alloy so that the thermal expansion due to the rise in temperature of the engine E does not lead to expansion of clearance between the piston P (see FIG. 12) and the cylinder liner 5'. The composite portion 5*b* of each cylinder liner 5' are made of a metal matrix composite 11 that includes a ceramic compact 7 having a three-dimensional mesh structure 10 comprised of a plurality of spherical cells 8 and a plurality of communicating pores 9 for allowing adjacent spherical cells 8 to communicate with each other, with the plurality of spherical cells 8 filled with a metal 12 (see FIG. 5).

In this embodiment, the metal matrix composite 11 used in at least part of the cylinder liner 5' is substantially the same as that used in the cylindrical body 6 of the first embodiment, except that the ceramic compact 7 is preformed into the shape of the cylinder liner 5' (composite portion 5*b* thereof) as shown in FIG. 10, and thus a duplicate description will be omitted.

<Process for Manufacturing Cylinder Block>

The ceramic compact production process S1 (see FIG. 6) as described in relation to the first embodiment may be applied to the present embodiment. In the present embodiment, by following the substantially the same process as the process S1 (steps 2–5), ceramic compacts 7 cylindrically shaped into the form of cylinder liners 5' (composite portions 5*b* thereof) are obtained.

Next, in cylinder block production process S6 as described in detail in relation to the first embodiment, the ceramic compacts 7 thus formed are used as preforms of the cylinder liners 5' (metal matrix composite 11) to manufacture a cylinder block 1 integrated with the cylinder liners 5'

The ceramic compacts 7 each shaped into the form of the cylinder liner 5' are placed as inserts in a mold, and an aluminum alloy (metal 12) is poured into the mold to form a cylinder block 1 and a cylinder liner 5' embedded therein at the same time. As shown in FIG. 6, the cylinder block production process S6 is principally comprised of in-mold placement step S7, composite casting step S8 and working step S9, through which a cylinder block 1 with composite parts incorporated around the bores 5*a* (in the present embodiment, composite portions 5*b* of the cylinder liners 5') are manufactured. The steps S7–S9 in the present embodiment are substantially the same as in the first embodiment, and thus a duplicate description thereof will be omitted. In short, in the present embodiment, the ceramic compacts 7 for the cylindrical bodies 7 are not placed in the mold in step S7, but the ceramic compacts 7 for the cylinder liners 5' (composite portions 5*b* thereof) are placed at predetermined positions in the mold. In composite casting step S8, for example an aluminum alloy is poured into the mold, and the cylinder block 1 having the cylinder liner 5' insert-molded therein are formed, so that the cylinder block 1 and the cylinder liner 5' are of monolithic construction. Accordingly, the cylinder liners 5' having spherical cells 8 filled with the aluminum alloy (metal 12) are integrated with the cylinder block 1, while the water jackets 1*d*, 1*e*, 1*f* are formed in the cylinder block 1.

Next, the cylinder block 1 formed in composite casting step S8 is removed from the mold and cooled; the process then goes to working step S9, in which a tapping work for forming internal thread portions 1*h* in the interior of the bolt hole 6*a* as shown in FIG. 10 and a grinding work to remove burrs formed in the casting step are carried out to finish the final casting. Resultantly, the cylinder block 1 of which portions around the bores 5*a* are made of the metal matrix composite 11 can be manufactured.

Next, the cylinder block 1 that has been manufactured as described above is subjected to an assembly process, in which a gasket 2 is placed on the deck surface 1*a*, and a cylinder head 4 is placed on the gasket 2, as shown in FIG. 1. Thereafter, over the cylinder head 4 is attached a head cover (not shown), and beneath the cylinder block 1 is attached a lower case (not shown) to which an oil pan (not shown) is attached, with the result that the assembly process of the engine E is completed.

<Operation>

When the engine E that has been completed as described above is brought into operation, the operation evolves heat. Thus generated heat raises the temperatures of the cylinder block 1, the cylinder liners 5' thereof, the piston P, etc. which are also cooled by the coolant flowing in the water jackets 1*d*, 1*e* formed in the cylinder block 1, so that the cylinder block 1 are maintained within a predetermined range of temperatures.

In the cylinder block 1 of which a cylinder liner 5' (composite portion 5*b* thereof) is made of a metal matrix composite 11, the cylinder liner 5' is high in rigidity or in other aspects of mechanical strength. Since the cylinder block 1 according to the present embodiment includes such a cylinder liner 5' having a high mechanical strength (e.g., rigidity, etc.), the rigidity/strength of the cylinder liner 5' is higher than that of the conventional cylinder liner made of cast iron or stainless steel, and thus the use of the cylinder block 1 according to the present embodiment makes it possible to manufacture an engine E having an increased output power without design changes which would require increase in dimension of the engine E.

Further, in the engine E as a whole, the enhanced rigidity of the portions around the bores 5*a* serves to improve the sealing capability for preventing a leak of combustion gases; the improved thermal conductivity of the portions around the bores 5*a* allows the portions around the bores 5*a* to swiftly cool down; and the reduced thermal expansion of the portions around the bores 5*a* serves to prevent the clearance between the cylinder liners 5' and the pistons reciprocating inside the cylinder liners 5' from increasing under high temperature conditions, even when the cylinder block 1 expands and contracts due to change in temperature resulting from operation of the engine E.

Each cylinder liner 5' is made of a metal matrix composite 11 having a ceramic compact 7 of a three-dimensional mesh structure 10 with a plurality of uniformly distributed spherical cells 8 filled with an aluminum alloy (metal 12), and thus exhibits a higher thermal conductivity, a higher rigidity and a lower coefficient of thermal expansion than an aluminum alloy making up the cylinder block 1. Therefore, the thermal expansion of the cylinder liner 5' is restricted, so that the clearance between the cylinder liner 5' and the piston P can be prevented from increasing. Further, the cylinder liners 5' are so high in thermal conductivity that heat may be transferred swiftly; thus, the cylinder liners 5' can be cooled swiftly.

<Advantageous Effects of Second Embodiment>

The cylinder liner 5' formed by following the processes S1 (steps S2–S5) and S6 (steps S7–9) brings about at least any one of advantageous effects as follows.

(1) The metal 12 with which the spherical cells 8 are filled assumes spherical shapes as shown in FIG. 5, and thus exhibits no anisotropic property in thermal expansion.

(2) In the cylinder liner 5', the metal 12 is bound with the spherical cells 8 that are higher in rigidity than the metal 12 and is distributed densely and uniformly to form a three-dimensional mesh structure 10 of the metal matrix composite 11, and thus exhibits a rigidity higher than a conventional metal matrix composite. Thus enhanced rigidity of the portions around the bores 5*a* improves a sealing capability so that a higher combustion pressure that could not be sealed conventionally can be sealed with the same level of axial fastening force as conventionally applied to the head bolts 3 as shown in FIG. 1. Further, the buckling strength of a surface of a gasket 2 (see FIG. 1) at which the gasket 2 is fastened to the cylinder block 1 is improved, so that the bearing stress of the surface of the gasket 2 can be increased.

(3) In the cylinder liner 5', the metal 12 is bound with the spherical cells 8 that are lower in coefficient of thermal expansion than the metal 12 and is distributed densely and uniformly to form a three-dimensional mesh structure 10 of the metal matrix composite 11, and thus the metal 12 contained in the metal matrix composite 11 thermally expands in a uniform manner. Accordingly, the coefficient of thermal expansion of the cylinder liner 5' is lower than those of any conventional metal matrix composites and other materials. Further the lowered coefficient of thermal expansion around the bore 5*a* serves to restrict the clearance between the piston P and the bore 5*a*, whereby the characteristics of the engine E for preventing noises, vibrations and blowby can be improved.

(4) The cylinder liner 5' is adapted to include the ceramic compact 7 made of ceramics (spherical cells) that is higher in thermal conductivity than the metal and thus allows heat to be transferred through the ceramics rather than the metal, so that the thermal conductivity can be improved. Accordingly, the cooling performance of the portions around the bore 5*a* can be improved, so that an increased output power of the engine E can be achieved.

(5) The metal matrix composite 11 making up the cylinder liner 5' has metal 12 in the spherical cells 8 arranged in a closest packed structure, which serves to improve the mechanical strength and shock resistance of the ceramic compact 7, and thus enhancing the mechanical strength of the cylinder liner 5'. As a result, the volume fraction Vf of ceramic compact 7 in the metal matrix composite 11 can be reduced so that the metal matrix composite 11 having increased hollow spaces in the spherical cells 8 can be easily impregnated with the molten metal 12.

(6) In cases where the cylinder liner 5' made of metal matrix composite 11 is formed using a ceramic compact 7 in which a ratio ($M_d/M_D$) of a median ($M_d$) of the inside diameters of the communicating pores 9 to a median ($M_D$) of the inside diameters of the spherical cells 8 is adapted to be lower than 0.5, the coefficient of thermal expansion of the metal matrix composite 11 can be further reduced, so that the expansion that would occur in the bore 5*a* after warming up the engine E can be reduced and the clearance between the cylinder block 1 and the piston P can be checked and minimized; thereby, unsteadily swaying motion of the piston can be prevented. Moreover, the piston ring can be prevented from widening and loosening, so that the oil can be prevented from being wasted and deteriorated.

It is noted that the present invention is not limited to the above embodiment, and various modifications and changes may be made in the present invention without departing from the spirit and scope thereof.

<Modification Examples>

Figure 13:
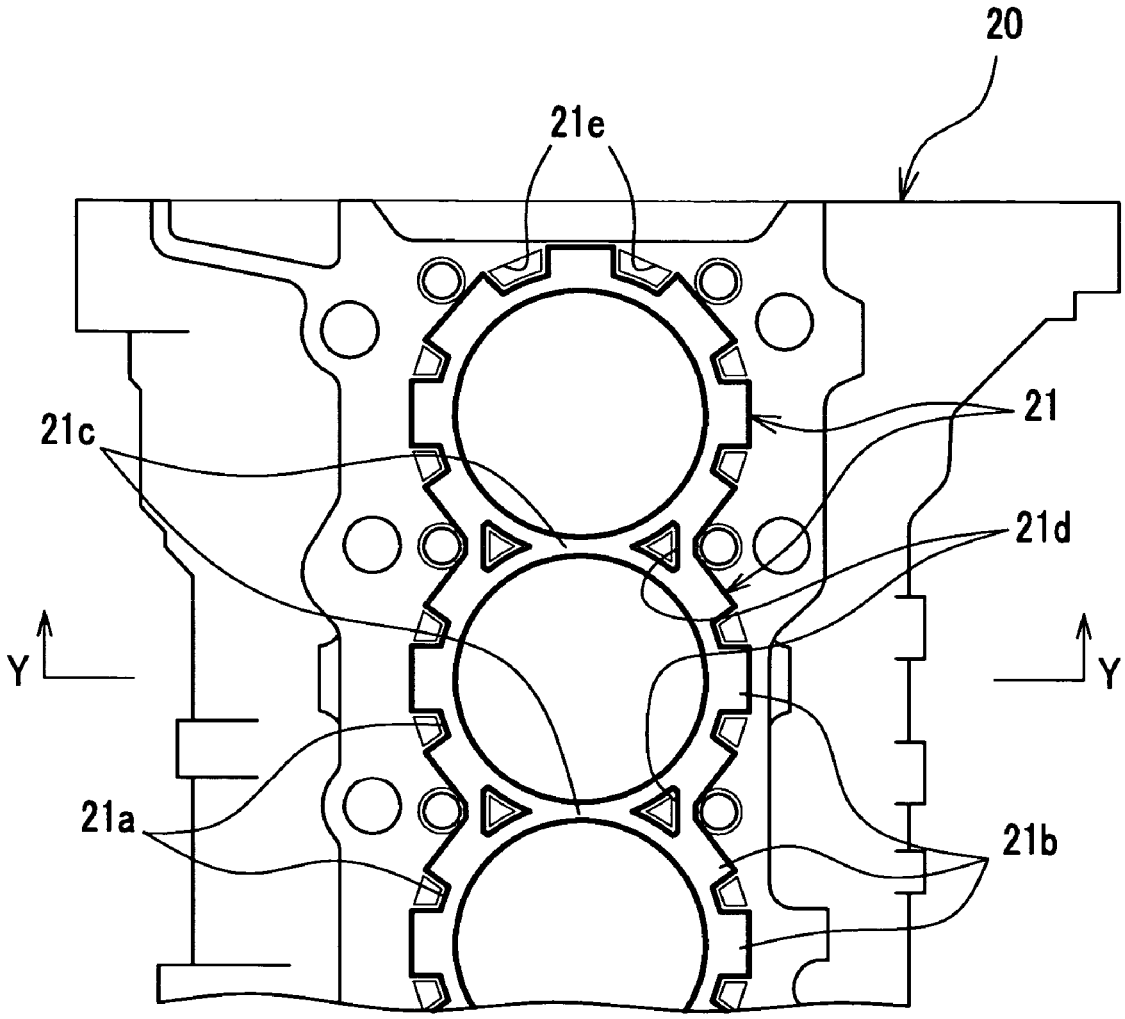
FIG. 13 is a plan view showing a principal portion of a cylinder block as a modified example of the cylinder block according to the second embodiment of the present invention.

A description will be given of modified examples of the cylinder block according to the second embodiment of the present invention with reference to FIGS. 13 and 14. FIG. 13 is a plan view showing a principal portion of the cylinder block, and FIG. 14 is a sectional view taken along line Y—Y of FIG. 13.

For example, the cylinder liner 5' (metal matrix composite 11) may not necessarily be cylindrical as shown in FIG. 10. The cylinder liner 5' (metal matrix composite 11) may be shaped in any form having a bore 5*a* inside; for example, as shown in FIGS. 13 and 14, there may be provided cylinder liners 21 each having flange-like projections 21*b* outwardly protruding at upper and lower end portions on an outer cylindrical surfaces 21*a* thereof. Water jackets 21*e* may be provided between adjacent projections 21*b*, as shown in FIG. 13.

Further, as shown in FIG. 13, water jackets 21*e* may be provided in the projections 21*b* formed at joined portions 21*c* of adjacent cylinder liners 21.

Figure 14:
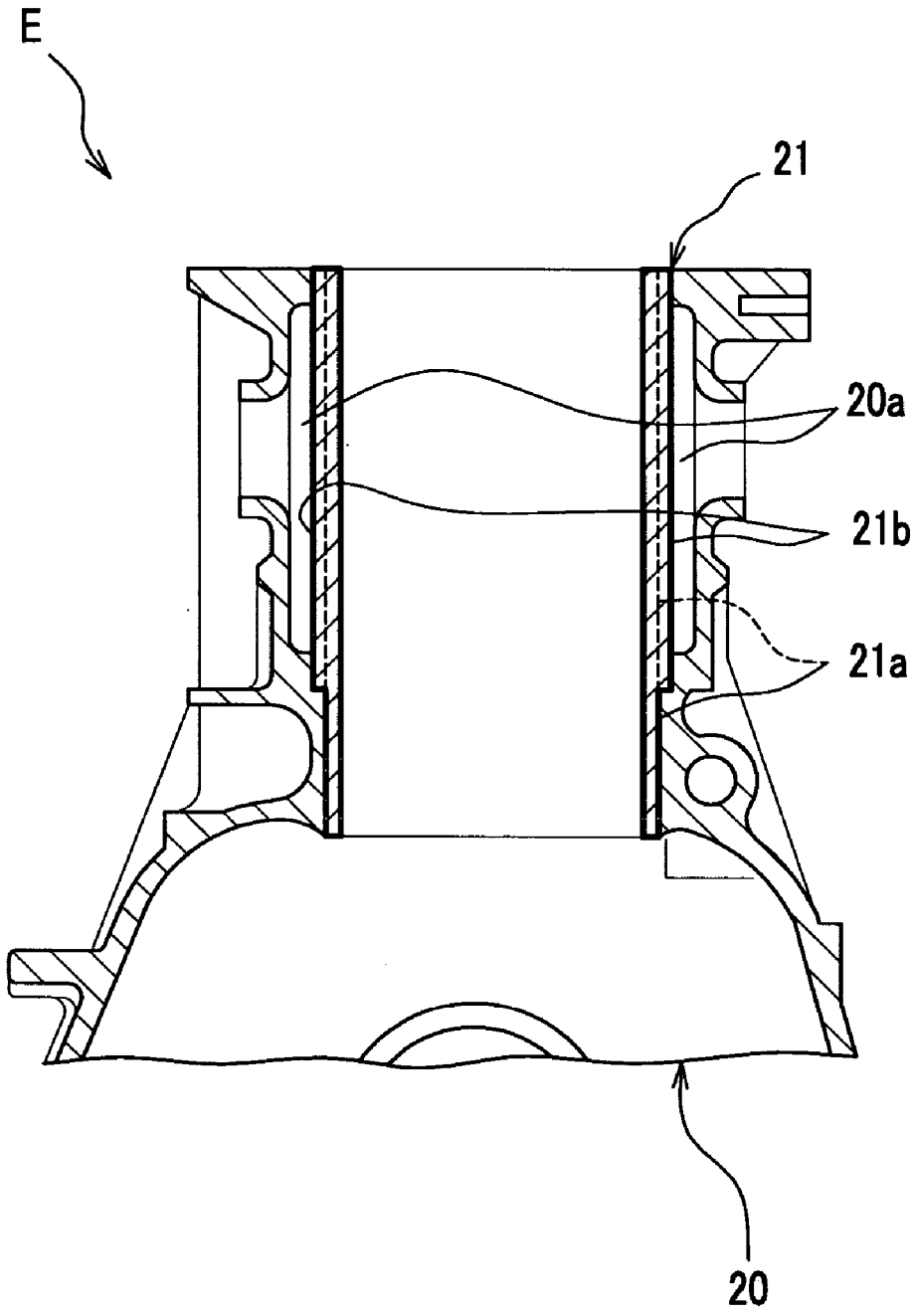
FIG. 14 is a sectional view taken along line Y—Y of FIG. 13.

Furthermore, as shown in FIG. 14, water jackets 20*a* may be provided in positions facing part of an outer cylindrical surface 21*a* of the cylinder liner 21 so that the part of the outer cylindrical surface 21*a* of the cylinder liner 21 constitutes a part of an inner wall of a water jacket 20*a*.

The water jackets 21*d*, 20*a* formed directly in or on the cylinder liner 21 exhibits an increased cooling efficiency for cooling the cylinder liner 21, and thus serves to restrict the clearance between the cylinder liner 21 and the piston P (see FIG. 12) from increasing.

Moreover, the above-described embodiments exemplify a face-centered closest packed structure of the ceramic compact 7 in which the spherical cells 8 are arranged to form a face-centered cubic lattice; the structures of the ceramic compact 7 consistent with the present invention may include a hexagonal closest packed structure and a body-centered closest packed structure. Further, the spherical cells 8 may be arranged in an "amorphous" (random) fashion.

In the above-described embodiments, the ceramic compact 7 is illustrated as having a substantially cubic shape; however, the shape of the ceramic compact 7 consistent with the present invention may be changed according to the desired shape of the metal matrix composite 11 to be manufactured.

The process (S1 plus S6) of manufacturing a cylinder block 1 may be arranged to comprise the steps S2 through S5 by which ceramic compacts 7 as preforms for cylinder liners 5' are produced as in the above embodiment, followed by the step of filling the ceramic compacts 7 with metal 12 such as an aluminum alloy to make the metal matrix composite 11 (see FIG. 5) as cylinder liners 5' in finished form, before placing them in a mold for the cylinder block 1 in step S7 and pouring the metal 12 to make the cylinder liners 5' integrated with the cylinder block 1 in step S8; thereafter working process S9 is carried out as in the above embodiment.

According to this arrangement of the process of manufacturing a cylinder block 1, as well, the cylinder liners 5' that have been formed of the metal matrix composite 11 are insert-molded in the cylinder block 1, so that the cylinder liners 5' can be provided with a higher strength, higher rigidity, higher thermal conductivity, higher resistance to abrasion and lower coefficient of thermal expansion.

What is claimed is:

1. A cylinder block in which a bore is provided, comprising:

at least one member made of a metal matrix composite disposed around the bore, the metal matrix composite including a ceramic compact having a three-dimensional mesh structure comprised of a plurality of spherical cells and a plurality of communicating pores for allowing adjacent spherical cells to communicate with each other, with the plurality of spherical cells filled with a metal.

2. A cylinder block according to claim 1, wherein a volume fraction of the ceramic compact in the metal matrix composite is in a range of 10 to 40%.

3. A cylinder block according to claim 1, wherein the ceramic compact includes one of SiC, $Si_3N_4$, $Al_2O_3$ and AlN.

4. A cylinder block according to claim 1, wherein a ratio of a median of inside diameters of the communicating pores to a median of inside diameters of the spherical cells is lower than 0.5.

5. A cylinder block according to claim 1, wherein the at least one member made of the metal matrix composite includes a cylindrical body which allows a head bolt to be inserted therethrough into the cylinder block when a cylinder head is fastened to a deck surface of the cylinder block.

6. A cylinder block according to claim 5, wherein the cylindrical body is disposed in such a manner as to have one end thereof exposed at the deck surface and to define an opening and a portion adjacent thereto of a bolt hole of the cylinder block, and at least a midsection of the head bolt is disposed inside the cylindrical body when the head bolt is applied with an external thread portion thereof screwed in and engaged with an internal thread portion formed in an interior of the cylinder block; and wherein an inside diameter of the cylindrical body is larger than a minor diameter of the internal thread portion by 10% or more.

7. A cylinder block according to claim 5, wherein a part of an outer cylindrical surface of the cylindrical body constitutes a part of an inner wall of a water jacket.

8. A cylinder block according to claim 1, wherein the at least one member made of the metal matrix composite includes a cylinder liner.

9. A cylinder block according to claim 8, wherein the cylinder liner is disposed between the bore and a water jacket disposed around the bore.

10. A cylinder block according to claim 8, wherein a water jacket is formed in the cylinder liner.

11. A cylinder block according to claim 8, wherein a part of an outer cylindrical surface of the cylinder liner constitutes a part of an inner wall of a water jacket.

12. A cylindrical block according to claim 1, wherein the at least one member made of the metal matrix composite includes a water jacket.

13. A cylinder block according to claim 1, wherein the cylinder block is molded of the metal with which the ceramic compact is filled whereby the cylinder block and the at least one member made of the metal matrix composite are of monolithic construction.

14. A process for manufacturing a cylinder block comprising:

providing a ceramic compact shaped in a predetermined form with a three-dimensional mesh structure comprised of a plurality of spherical cells and a plurality of communicating pores for allowing adjacent spherical cells to communicate with each other;

placing the ceramic compact at a predetermined position in a mold; and supplying a metal material into the mold.

15. A cylinder block manufactured by the process according to claim 14.

* * * * *